US009469960B2

(12) United States Patent
Naquin, Jr. et al.

(10) Patent No.: US 9,469,960 B2
(45) Date of Patent: Oct. 18, 2016

(54) METHOD OF AND APPARATUS FOR INSTALLATION OF PLATE ANCHORS

(71) Applicant: Intermoor Inc., Morgan City, LA (US)

(72) Inventors: Andrew Naquin, Jr., Morgan City, LA (US); Michael H. Aleksines, Morgan City, LA (US); Jonathon D. Miller, Brookshire, TX (US)

(73) Assignee: Intermoor Inc., Morgan City, LA (US)

( * ) Notice: Subject to any disclaimer, the term of this patent is extended or adjusted under 35 U.S.C. 154(b) by 708 days.

(21) Appl. No.: 13/800,189

(22) Filed: Mar. 13, 2013

(65) Prior Publication Data

US 2014/0079489 A1 Mar. 20, 2014

Related U.S. Application Data

(60) Provisional application No. 61/703,558, filed on Sep. 20, 2012.

(51) Int. Cl.
*E02D 5/80* (2006.01)
*B63B 21/27* (2006.01)

(52) U.S. Cl.
CPC ..... *E02D 5/80* (2013.01)

(58) Field of Classification Search
CPC . E02D 5/80; E02D 11/00; E02D 2250/0053; B63B 2021/007; B63B 21/22; B63B 21/26; B63B 21/27; B63B 21/50; B63B 2021/262
USPC ..... 405/224; 114/295, 296; 37/345
See application file for complete search history.

(56) References Cited

U.S. PATENT DOCUMENTS

| | | | | |
|---|---|---|---|---|
| 3,850,128 | A * | 11/1974 | Lovell | B63B 21/26 114/295 |
| 5,992,060 | A | 11/1999 | Treu et al. | |
| 6,003,466 | A | 12/1999 | Dove et al. | |
| 6,122,847 | A | 9/2000 | Treu et al. | |
| 6,360,682 | B1 * | 3/2002 | Riemers | B63B 21/27 114/296 |
| 6,598,555 | B1 * | 7/2003 | Bruce | B63B 21/26 114/294 |
| 6,910,831 | B2 * | 6/2005 | Raines | B63B 21/29 405/224.1 |
| 7,770,655 | B2 | 8/2010 | Wilde et al. | |
| 2002/0129755 | A1 | 9/2002 | Hagen et al. | |
| 2003/0218937 | A1 * | 11/2003 | Berg | G01V 1/3852 367/16 |
| 2008/0141922 | A1 | 6/2008 | Muehlner | |
| 2012/0087208 | A1 | 4/2012 | Thompson et al. | |

FOREIGN PATENT DOCUMENTS

BR PI06050115 A 7/2008

OTHER PUBLICATIONS

Internal Search Report, Method Of And Apparatus For Installation Of Plate Anchors, May 21, 2013, 2 pgs.

* cited by examiner

*Primary Examiner* — Benjamin Fiorello
*Assistant Examiner* — Stacy Warren
(74) *Attorney, Agent, or Firm* — Egan, Peterman, Enders & Huston LLP.

(57) ABSTRACT

Methods and apparatus are disclosed for deploying one or more plate anchors on the seafloor prior to later installation (embedment) of the plate anchors using an installation tool such as a suction follower. The methods and apparatus may be used for batch-setting multiple plate anchors on the seafloor for a drilling vessel mooring in which the plate anchors and an installation tool are subsequently engaged for subsequent suction embedment of the plate anchors to design penetration depth.

33 Claims, 34 Drawing Sheets

METHOD OF AND APPARATUS FOR INSTALLATION OF PLATE ANCHORS

The present application claims priority to U.S. Provisional Patent Application Ser. No. 61/703,558 filed Sep. 20, 2012 and entitled "METHOD OF AND APPARATUS FOR INSTALLATION OF PLATE ANCHORS" by Naquin et al., the disclosure of which is incorporated herein by reference in its entirety.

FIELD OF THE INVENTION

This invention relates generally to mooring systems and methods for drilling vessels.

BACKGROUND

The method of installation for the direct-embedment plate anchor know in the industry as the SEPLA™ anchor (Suction Embedded Plate Anchor) uses a modified suction pile (i.e. suction follower) as the installation tool in order to insert (install) the anchor to its design penetration depth in the seafloor (ref. U.S. Pat. Nos. 5,992,060 and 6,122,847). Using conventional SEPLA anchor installation methodology, the suction follower is lowered from the sea surface with a single plate anchor loaded on the suction follower for installation. The suction follower is then recovered to the sea surface after seafloor installation of the anchor, and the next plate anchor to be installed is then loaded on the suction follower which is then lowered again from the sea surface. This process is repeated for installation of each separate plate anchor. Thus, total installation time for a set of multiple plate anchors includes the time required for recovering the suction follower and again lowering it for installation of each separate anchor.

It is known in a first operation to vertically lower multiple piles or conductor pipes into the water and down to self-weight penetration depth at designated locations in the seafloor, and then in a following second operation to lower a hammer apparatus into the water and to use the hammer apparatus to drive each of the multiple piles or conductor pipes to grade without recovering the hammer apparatus above the water surface until all of the multiple piles or conductor pipes have been driven to grade by the hammer apparatus.

SUMMARY OF THE INVENTION

Disclosed herein are methods of and apparatus for installation of plate anchors for drilling vessels such as drillships and mobile offshore drilling units (MODUs). The disclosed methods and apparatus may be implemented in one exemplary embodiment to provide for multiple plate anchors to be set out on the seafloor prior to the single deployment of the suction follower, e.g., all of the drilling vessels plate anchors for a drilling vessel may be set out on the seafloor prior to the single deployment of the suction follower. Once the suction follower is deployed to depth from an installation vessel, it may be employed to sequentially dock to the separate batch-set plate anchors and embed each to its design penetration depth. In one exemplary embodiment, the follower is only raised above the seafloor (aka seabed) a nominal distance (and not to the sea surface) before moving to the next plate anchor location while the follower is suspended from the installation vessel on its lowering line.

Once the multiple anchor embedment process is completed, the suction follower may then be recovered to the installation vessel.

The disclosed methods and apparatus may be implemented in one exemplary embodiment to achieve a reduction in installation time, and enhanced competitiveness, over conventional plate anchor installation methods and apparatus. In this regard, such advantages over conventional methods and apparatus result in one embodiment from the relatively easy process of setting out the plate anchors without the use of the suction follower and from the ability to only deploy and recover the suction follower once to install a full complement of multiple anchors for a drilling vessel. Although advantageously employed for installing multiple plate anchors in a batch set manner, it will be understood that the disclosed methods and apparatus may also be employed to install a single plate anchor in a similar fashion.

In one exemplary embodiment multiple plate anchors may be first set out using a relatively smaller anchor handling vessel that is conventionally employed to carry both plate anchors and suction followers together for the conventional installation of the multiple plate anchors with the suction follower. This may be useful, for example, in a situation where a larger anchor handling vessel is not available. In this embodiment, a smaller vessel may be used that is not capable of carrying the multiple plate anchors together with the suction follower, but is less costly to operate than a relatively larger vessel that is capable of carrying both the multiple plate anchors and the suction followers together. In such an embodiment, once the multiple anchors have been set out by the vessel, it may return to port and load out a suction follower and return to the installation site to deploy the suction follower for installation (embedment) of the multiple plate anchors that have previously been set out on the seafloor by the same vessel.

In another exemplary embodiment, multiple plate anchors may be coupled together to form a linked anchor assembly that allows all of the multiple anchors to lowered together into the water for deployment in one operation. In one embodiment, adjacent pairs of multiple plate anchors of such a linked anchor assembly may be coupled together using anchor connection links that are configured to be uncoupled underwater (e.g., by a remote operated vehicle "ROV") so as to allow individual anchors to be detached one at a time from the anchor link assembly so that the individual anchors may be placed in separate different locations on the seafloor from each other. Advantageously, such a linked anchor assembly may be assembled from two or more separate anchors on the deck of an anchor installation or handling vessel, and then all of the assembled anchors lowered together over the side (as one linked anchor assembly) in one operation. Individual anchors may then be sequentially decoupled from the other assembled anchors underwater and deployed in separate different locations on the seafloor. Such decoupling of all the separate anchors of the linked anchor assembly may be accomplished in one embodiment without again raising the anchor link assembly to the sea surface, e.g., the linked anchor assembly may only be raised above the seafloor a nominal distance (and not to the sea surface) before moving to the next location for plate anchor deployment while the linked anchor assembly is suspended from the installation vessel on its lowering line. Thus, in one exemplary embodiment, multiple plate anchors may be batch-set on the seafloor in a first operation without again raising the linked anchor assembly to the surface of the water, followed by deployment of a suction follower (as described elsewhere herein) in a second operation to sequentially dock to the separate batch-set plate anchors and embed each to its design penetration depth before again raising the suction follower to the sea surface.

In another exemplary embodiment, multiple plate anchors may be first set out using a relatively smaller anchor handling vessel such as described above that is not capable of carrying a suction follower but which is less costly to operate than a relatively larger vessel that is capable of carrying both the multiple plate anchors and the suction followers together. In such an embodiment, once the multiple anchors have been set out by the smaller vessel, a relatively larger anchor handling vessel capable of carrying a suction follower may then be used to deploy a suction follower for installation (embedment) of the multiple plate anchors that have previously been set out on the seafloor by the smaller vessel.

In one respect, disclosed herein is a method for installing one or more plate anchors in a seafloor underlying a body of water, including: first deploying at least one plate anchor on the seafloor, the plate anchor including an anchor section; then deploying a suction follower into the body of water into a position suspended above the seafloor; then docking the deployed plate anchor to the suction follower, and lowering the suction follower with the docked plate anchor to embed the docked plate anchor into the seafloor; and then raising the suction follower above the seafloor to undock the embedded first anchor assembly from the suction follower.

In another respect, disclosed herein is a suction follower including an elongated follower body with a proximal end and a distal end. The suction follower may further include: an anchor docking feature provided at the distal end of the suction follower, the anchor docking feature being configured to at least partially receive a plate anchor in a docked embedding position; and an integral anchor retrieval mechanism configured to retrieve the plate anchor into the docked embedding position with the docking feature of the suction follower.

DESCRIPTION OF ILLUSTRATIVE EMBODIMENTS

Figure 1:
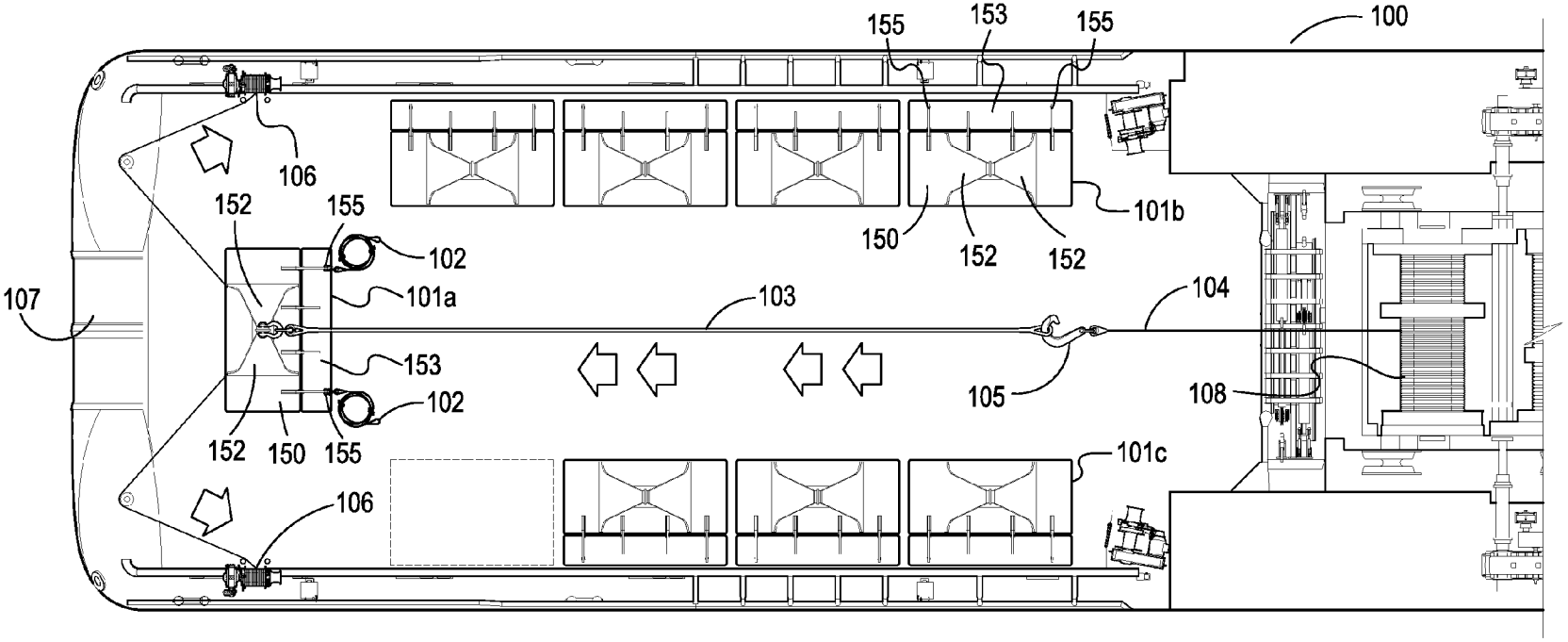
FIG. 1 illustrates an Anchor Handling Vessel (AHV) that has been loaded out with plate anchors and configured for batch-set handling according to one exemplary embodiment of the disclosed systems and methods.
Figure 2:
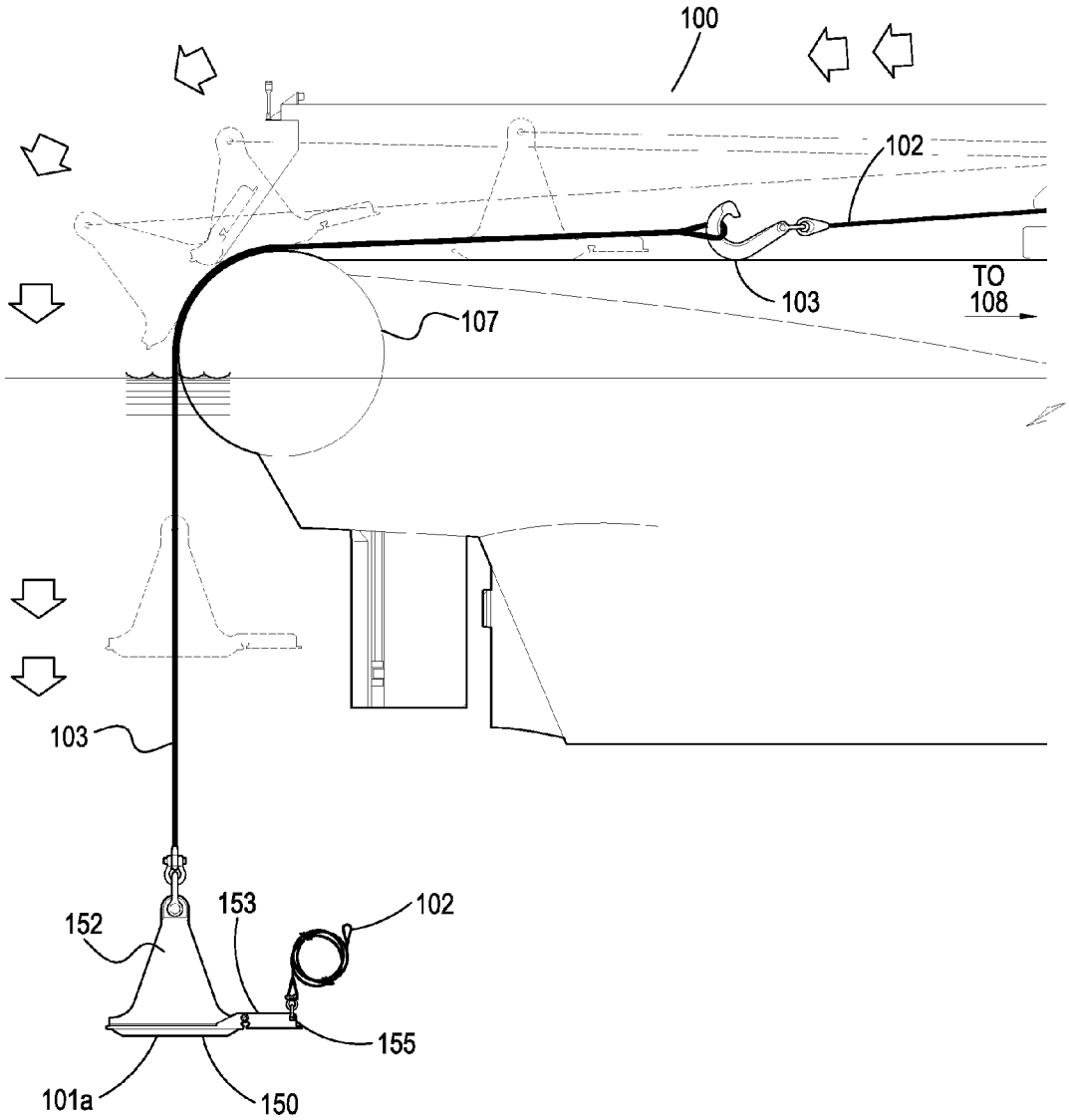
FIG. 2 illustrates the deployment of the plate anchor over the stern roller of an AHV according to one exemplary embodiment of the disclosed systems and methods.

FIG. 1 shows a typical Anchor Handling Vessel (AHV) 100 with a full complement of dual shank plate anchors 101 on deck configured for multiple (i.e., batch-set) installation in lieu of the conventional one-at-a-time method. Also illustrated as being present for this exemplary embodiment are the mooring pendant 103 and the recovery pendants 102. The pendants may be composed of synthetic fibers manufactured such that they are positively buoyant and can resist the abrasion associated with being immersed and pulled through the seafloor soils; they are known in the industry as mud ropes. Also shown are typical deck winches 106 that may be used in this embodiment to pull a plate anchor aft over the stern roller 107. The plate anchor to be deployed may be connected to the AHV's 100 aft anchor winch 108 via workwire 104 and a J-hook 105 to pendant line 103. FIG. 2 shows the anchor 101 being deployed over the stern roller 107 by deck winches 106 while being stabilized with backtension from the aft anchor winch 108. As shown, anchor 101 is suspended by its shanks 152 by mooring pendant 103 with fluke 150 oriented facing downwards. Mooring pendant 103 is coupled to an eyelet (padeye) provided at the top of shank 152, and recovery pendants 102 may be coupled to the keying flap 153 prior to deployment of each anchor 101 as shown. Although a plate anchor having dual solid steel shanks 152 is illustrated, it will be understood that the disclosed methods and apparatus may be employed to install other types of plate anchors including, but not limited to, plate anchors having a single (mono) steel shank 152, plate anchors having bridle-type shank/s, etc.

Figure 3A:
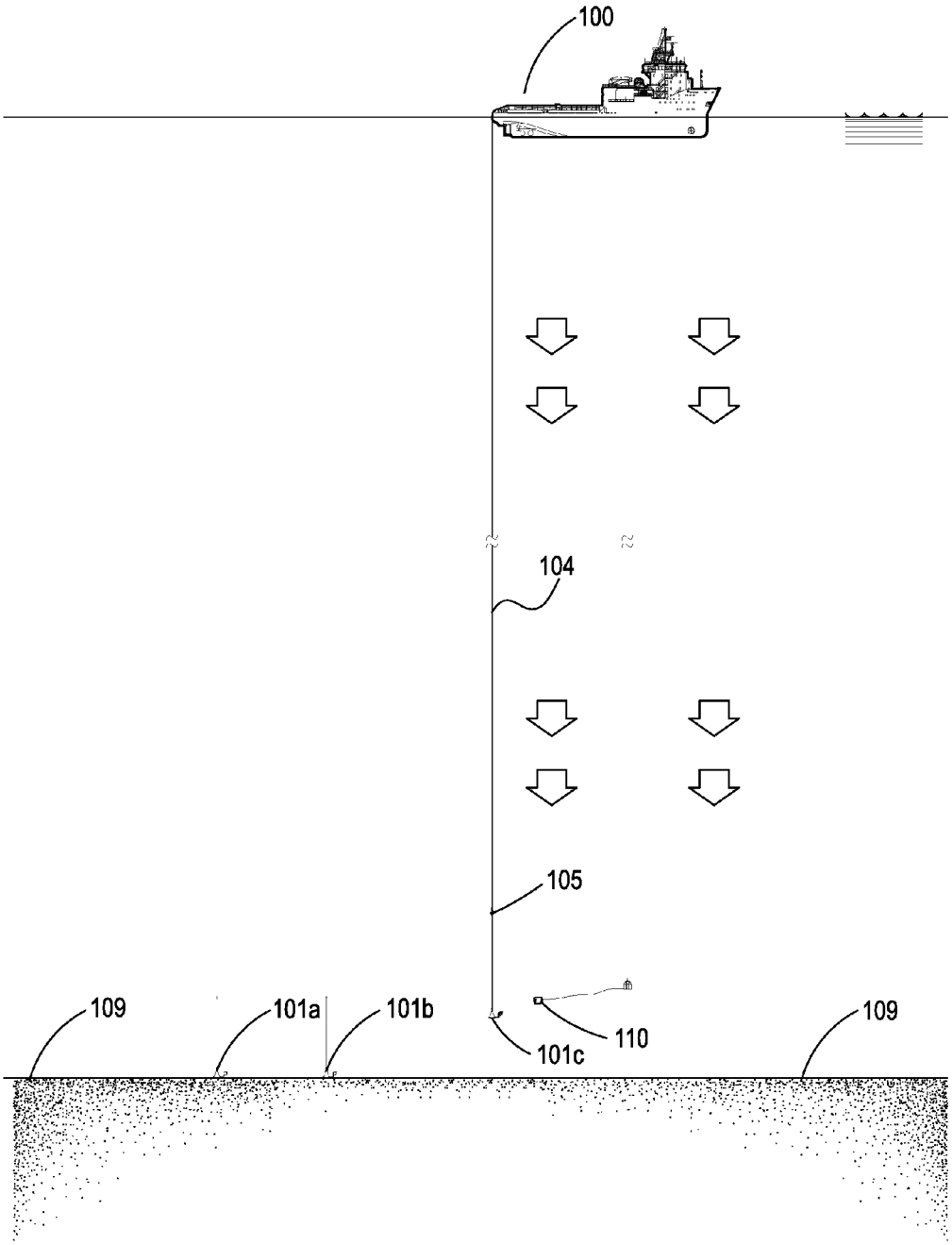
FIGS. 3A and 3B illustrate the placement on the seafloor and disconnection of the plate anchor according to one exemplary embodiment of the disclosed systems and methods.
Figure 3B:
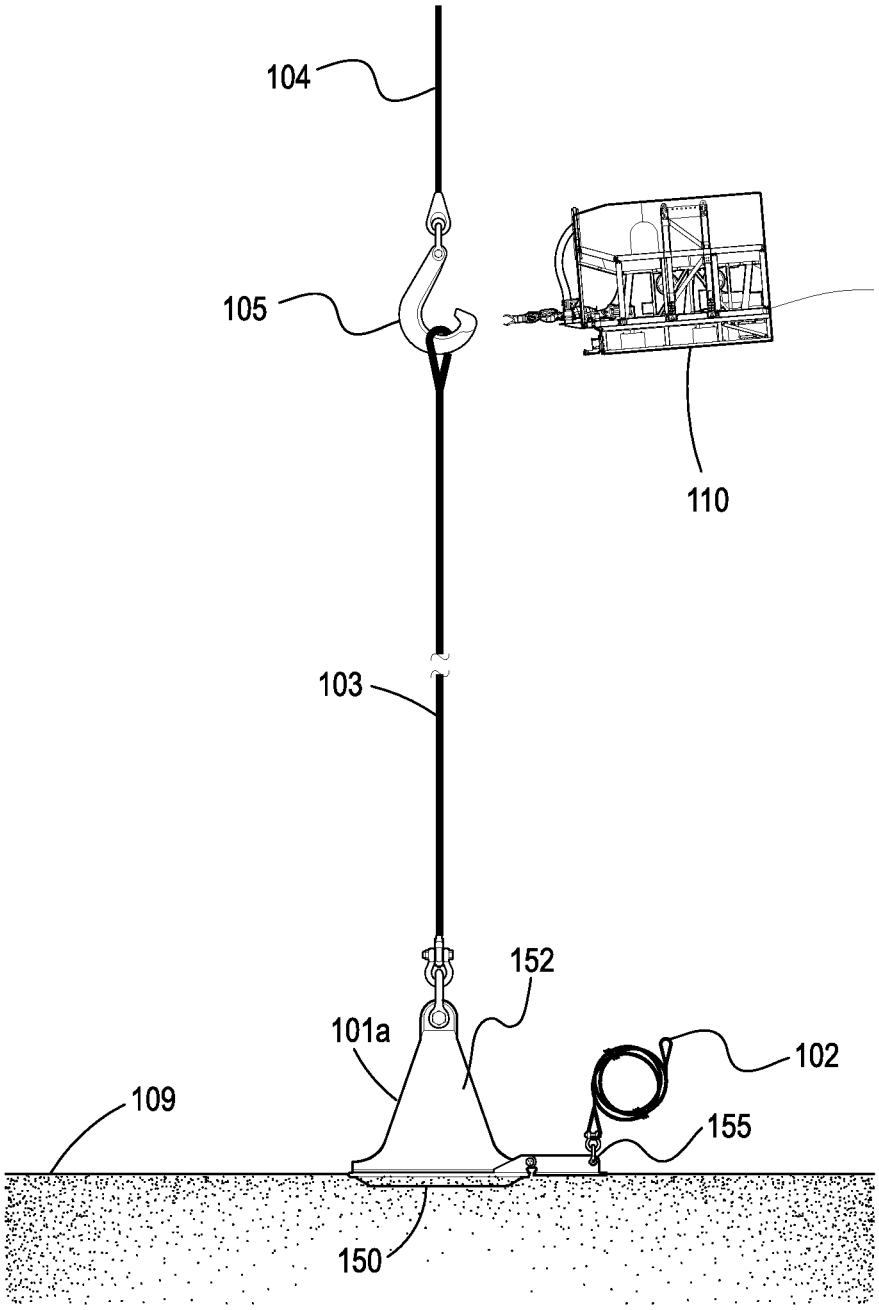

FIGS. 3A and 3B show the plate anchor 101 being placed on the seafloor 109 by the AHV 100, e.g., after confirming the location is correct. In FIG. 3A, plate anchor 101 has been further lowered into the water by the AHV to a distance of about 100 feet above seafloor 109. As shown in FIG. 3B, plate anchor 101 has been further lowered into the water by the AHV so that the flat surface of fluke 150 of plate anchor 101 is placed on seafloor 109 with shank 152 oriented upwards and keying flap 153 extending horizontally outward in substantially parallel relationship with seafloor 109. In this embodiment, the ROV 110 disconnects the pendant 103 from the J-hook 105 on the workwire 104 as shown in FIG. 3B. Also shown in FIG. 3A are other plate anchors 101 that have been previously lowered from AHV 100 and placed on the seafloor 109 in a similar manner as the current plate anchor 101. As shown, recovery pendants 102 are floating, as are mooring pendants 103 of each plate anchor 101.

Figure 4A:
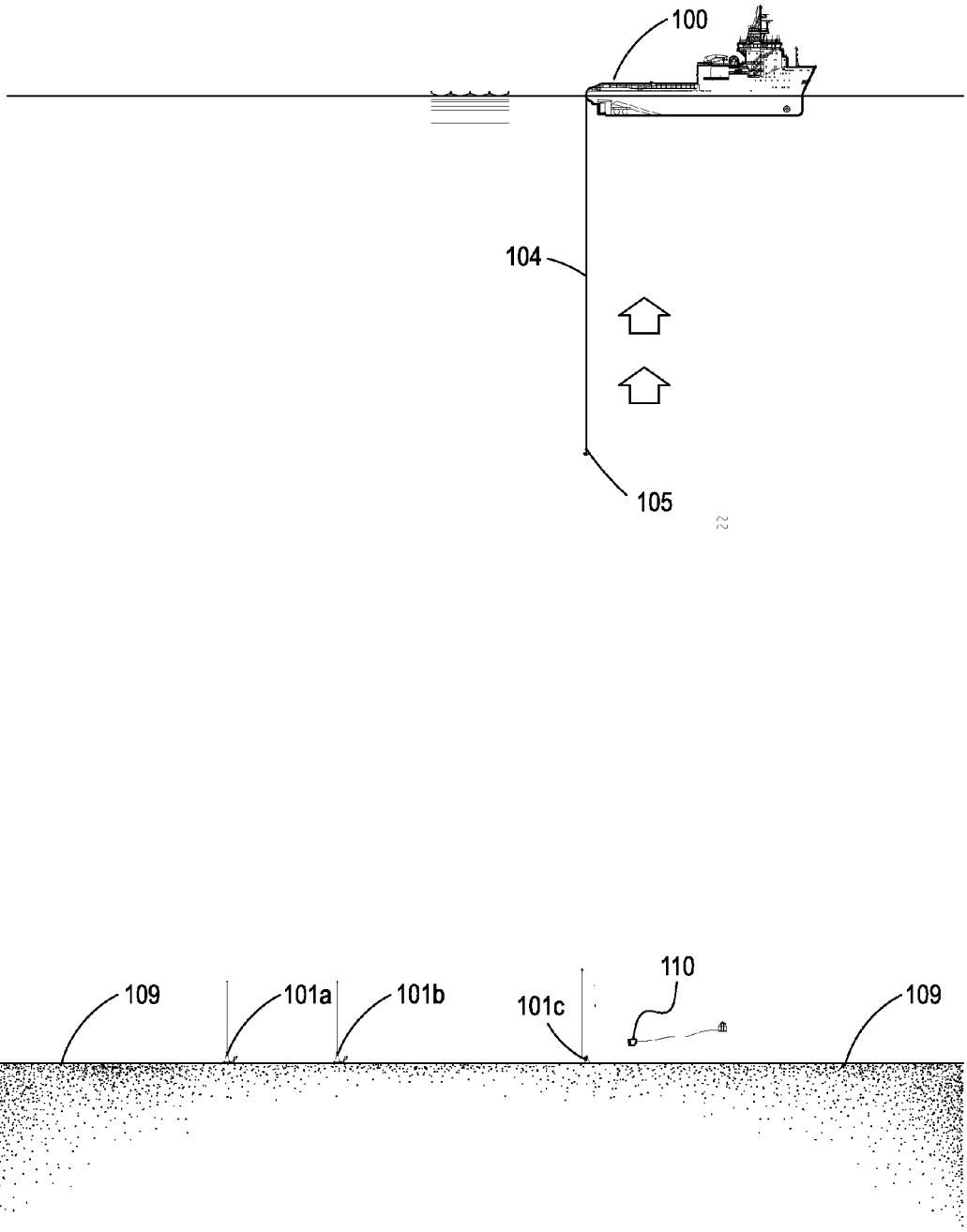
FIG. 4A illustrates the recovery of the workwire according to one exemplary embodiment of the disclosed systems and methods.
Figure 4B:
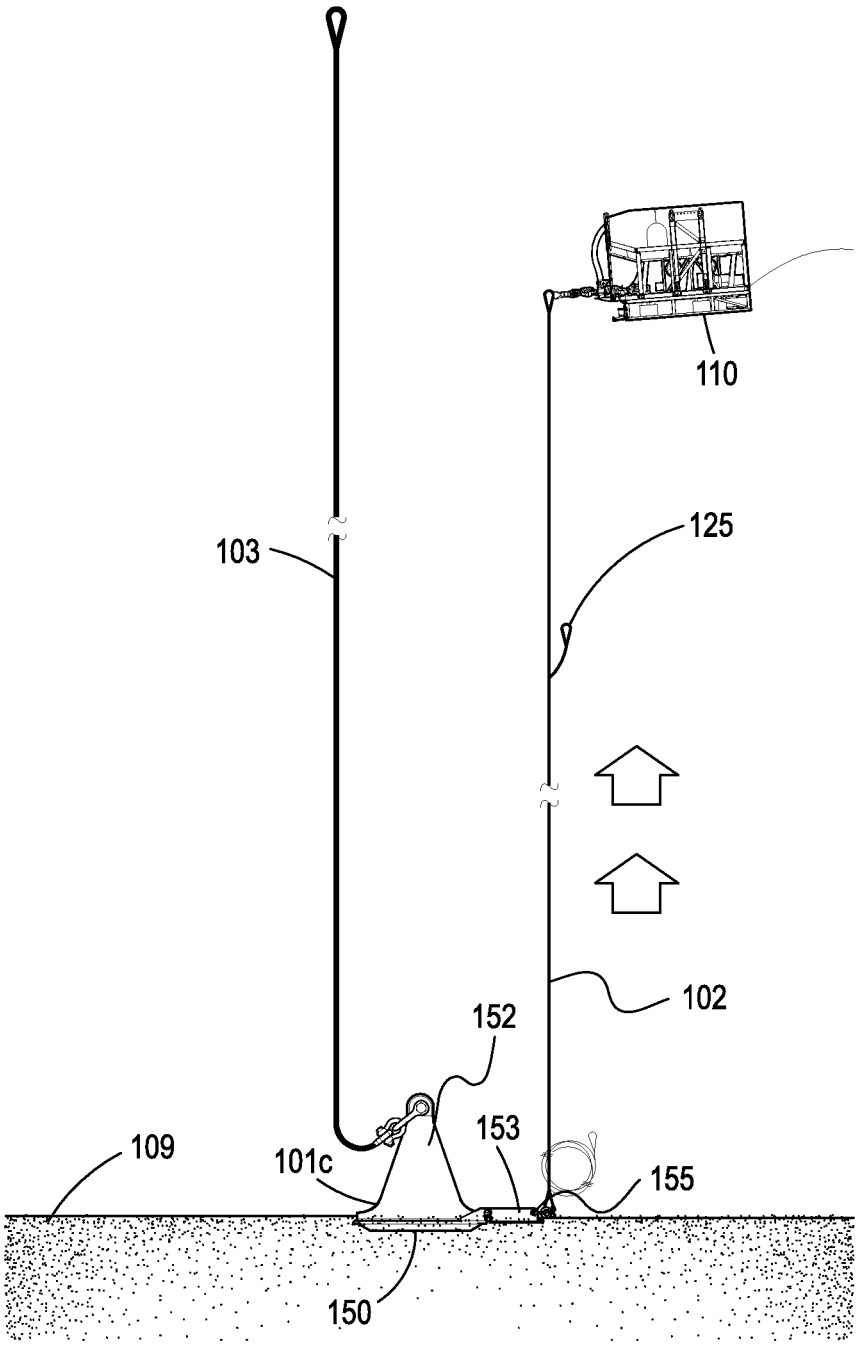
FIG. 4B illustrates recovery pendant deployment according to one exemplary embodiment of the disclosed systems and methods.

In FIG. 4A, the workwire 104 is recovered back to the AHV 100 and the ROV 110 deploys the recovery pendants 102 from their previously coiled configuration as shown in FIG. 4B. In one embodiment, a Yale grip 125 may be provided on the recovery pendant 102 for the purpose of pulling the plate anchor 101 into the suction follower 111's slot 194 while allowing the floating free ends of the recovery pendants to remain clear of the seafloor 109. Note that the Yale grip 125 on the recovery pendants is not visible in the coiled condition.

Figure 5:
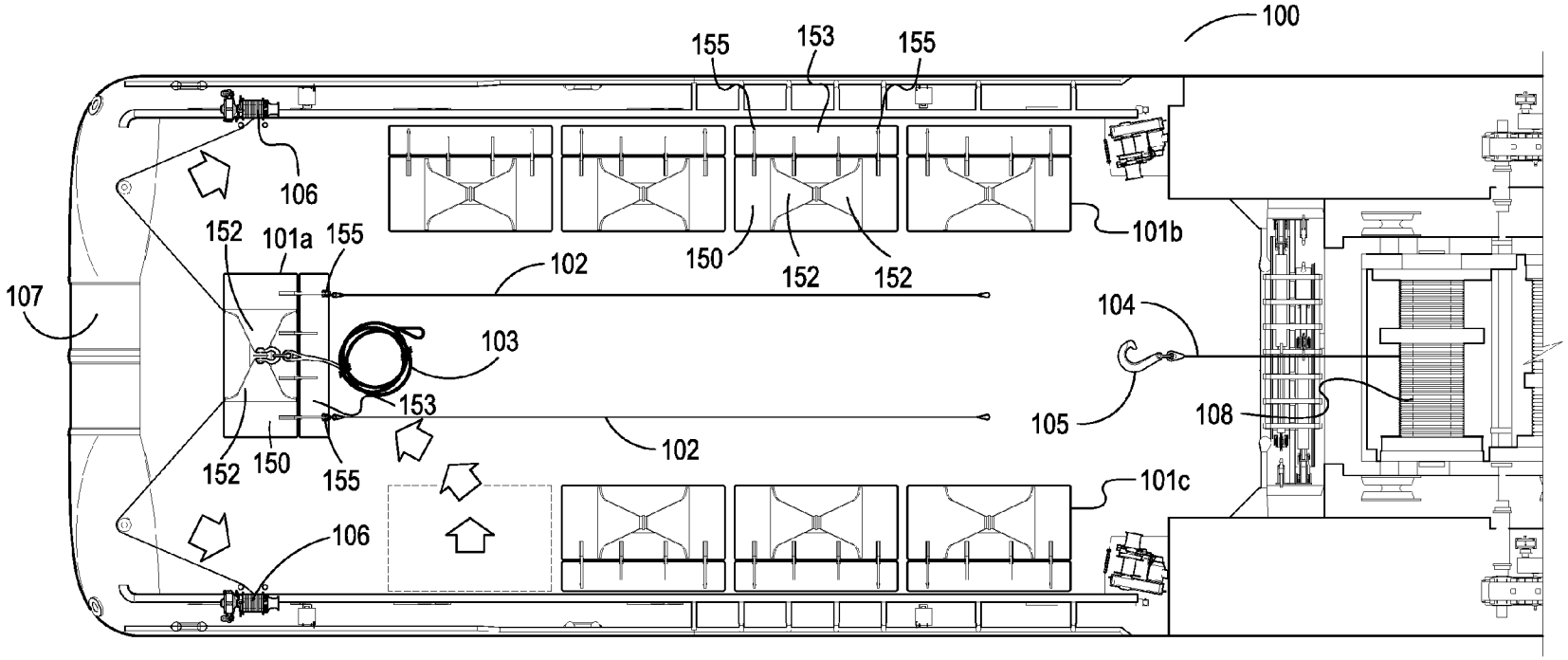
FIG. 5 illustrates an Anchor Handling Vessel (AHV) that has been loaded out with plate anchors and configured for batch-set handling according to one exemplary embodiment of the disclosed systems and methods.

FIG. 5 shows another exemplary embodiment of an AHV 100 with a full complement of eight dual shank plate anchors 101 on deck ready for batch-set installation using a method that includes linking the multiple anchors together and lowering them all together into the water as a linked anchor assembly. In the alternative embodiment of FIG. 5, similarly numbered components of AHV 100 may be of the configuration and type as described in relation to FIG. 1. Moreover, the same type and configuration of recovery pendants 102 and mooring pendant 103 may be attached to each anchor 101 as were employed in the embodiment of FIGS. 1-4. However, recovery pendants 102 and mooring pendant 103 may be utilized in a different manner in the embodiment of FIGS. 5-10 to provide a linked anchor assembly to allow the multiple anchors 101 to be lowered into the water together in one lowering operation. In this regard, mooring pendant 103 may be again coupled to an eyelet (padeye) provided at the top of shank 152 of each anchor 101, and recovery pendants 102 may be coupled to the keying flap 153 of each anchor 101 prior to deployment as shown. However, in this embodiment, the two recovery pendants 102 are attached to a first anchor 101*a* and extended in an outstretched side-by-side manner on the deck as shown, while mooring pendant 103 that is attached to the first anchor 101*a* remains coiled up or otherwise stowed during anchor deployment. As with other embodiments, although plate anchors 101 having dual solid steel shanks 152 are illustrated, it will be understood that the disclosed methods and apparatus may be employed to install other types of plate anchors including, but not limited to, plate anchors having a single (mono) steel shank 152, plate anchors having bridle-type shank/s, etc. Moreover, although eight anchors 101 are illustrated in FIGS. 5-10, it will be understood that the number of linked anchors that may be deployed together in the manner of FIGS. 5-10 may be greater or lesser than eight.

Figure 6:
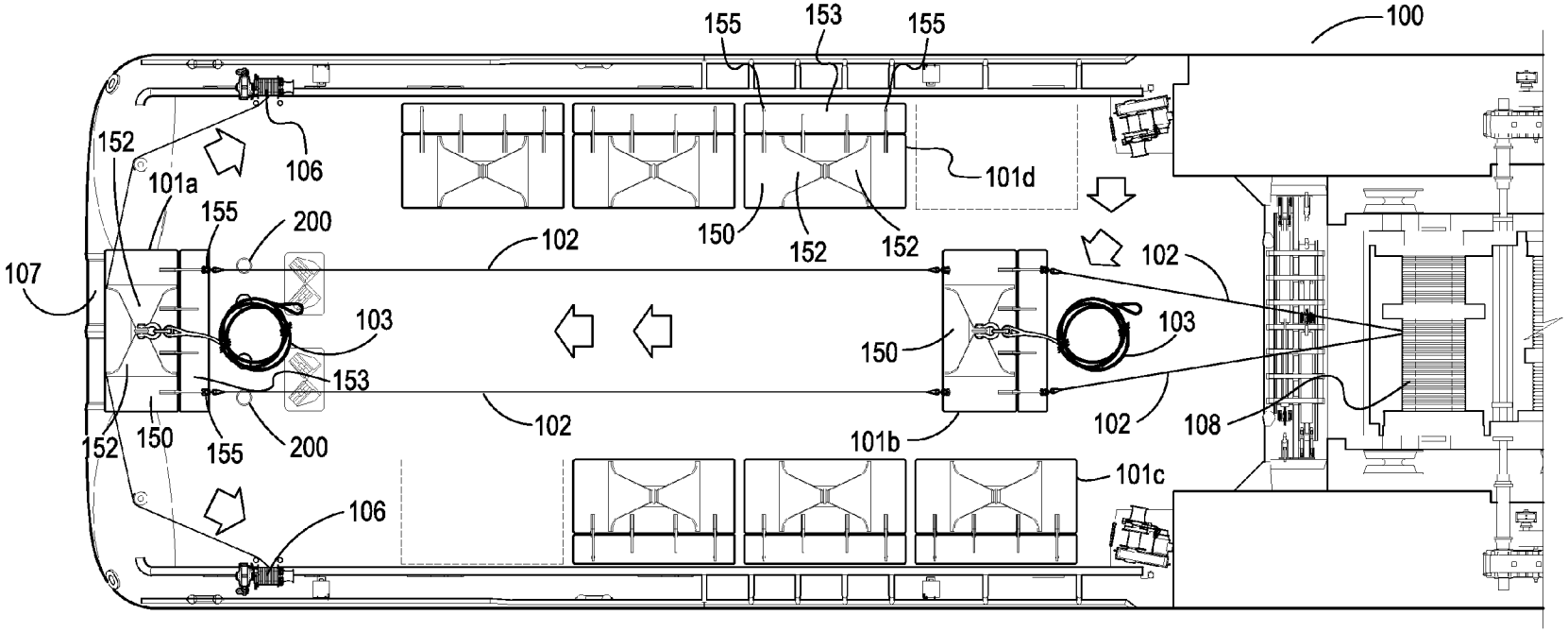
FIG. 6 illustrates a linked anchor assembly of plate anchors on the deck of a AHV according to one exemplary embodiment of the disclosed systems and methods.

FIG. 6 illustrates how first plate anchor 101*a* may be moved aft (in this case onto stern roller 107) using deck winches 106 in order to make room to move a second plate anchor 101*b* from its stowed position into an assembly position between first plate anchor 101*a* and winch 108. As shown, the outstretched recovery pendants 102 of first plate anchor 101*a* may be coupled between the keying flap 153 of first plate anchor 101*a* and the fluke 150 of second plate anchor 101*b* to form a linked anchor assembly of at least two plate anchors 101 that may be deployed together in one operation from AHV 100. As further shown, second plate anchor 101*b* may in turn be connected to the aft anchor winch 108 of AHV 100 by J-hook 105 (not shown) on the workwire 104 to provide backtension for stabilizing the linked anchors during their assembly. Additional anchors (e.g., in this case the remaining six plate anchors 101 on deck of AHV 100) may be added to the linked anchor assembly in a similar manner using additional pairs of recovery pendants 102.

It will be understood, however, that it is possible that other types of anchor connection links other than recovery pendants 102 may be employed to coupled together adjacent pairs of plate anchors 101 for use in the practice of the disclosed systems and methods. Examples of other types of anchor interconnection links include, but are not limited to, mooring pendants 103 coupled between the shank and fluke underside of adjacent pairs of anchors 101 (e.g., in which case recovery pendants 102 may be coiled up during lowering of the linked anchor assembly toward the seafloor), dedicated anchor linkage cables or lines that extend between any suitable portion of adjacent pairs of anchors 101 that allow each anchor 101 to be separately attached and deployed on the seafloor in a manner described elsewhere herein (e.g., in which case recovery pendants 102 and mooring pendants 103 may each be coiled up during lowering of the linked anchor assembly toward the seafloor), any other suitable mechanical connection link (e.g., non-flexible, hinged, swiveling, etc.), etc. In any case, as described elsewhere herein, anchor interconnection links may be configured to be detachable as appropriate (e.g., on one end or both end as needed) from anchors 101 of a linked anchor assembly, e.g., using a remote operated vehicle (ROV) in order to deploy anchors 101 on the seafloor.

Figure 7:
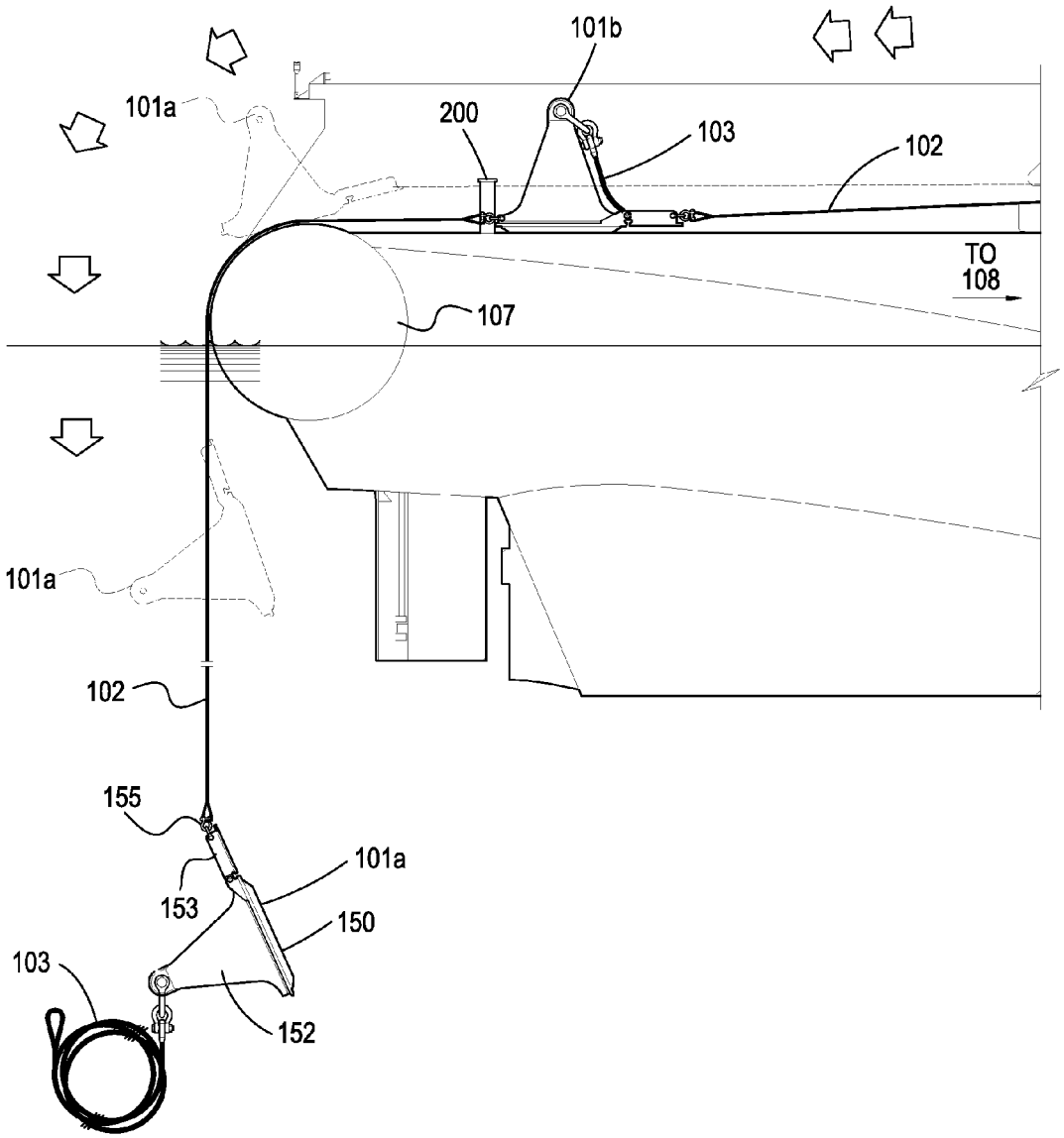
FIG. 7 illustrates the deployment of the first plate anchor of a linked anchor assembly over the stern roller of an AHV according to one exemplary embodiment of the disclosed systems and methods.

As shown in FIG. 7, the partially assembled linked anchor assembly may be lowered (e.g., one anchor at a time) over stern roller 107 into the water to create additional deck space for adding each additional anchor 101 in similar manner to the linked assembly. In this regard, FIG. 7 shows first anchor 101*a* being deployed over the stern roller 107 while the remainder of the linked anchor assembly (including second anchor 101*b* and its recovery pendants 102) is stabilized by raising the vessel's tow pins 200 such that the fluke of the anchor 101 bears on tow pins 200. As shown, first anchor 101*a* is suspended by its keying flap 153 by recovery pendants 102. When connecting additional anchors 101 to the linked anchor assembly, the tow pins 200 may be used to hold the partially-deployed linked anchor assembly in place when it is disconnected from aft winch 108 to allow an additional anchor 101 to be added to the linked anchor assembly on deck. Alternatively, temporary pendants may be attached between the keying flap 153 connection points and secure points on the work deck in order to support the linked anchors 101 during deployment.

Figure 8A:
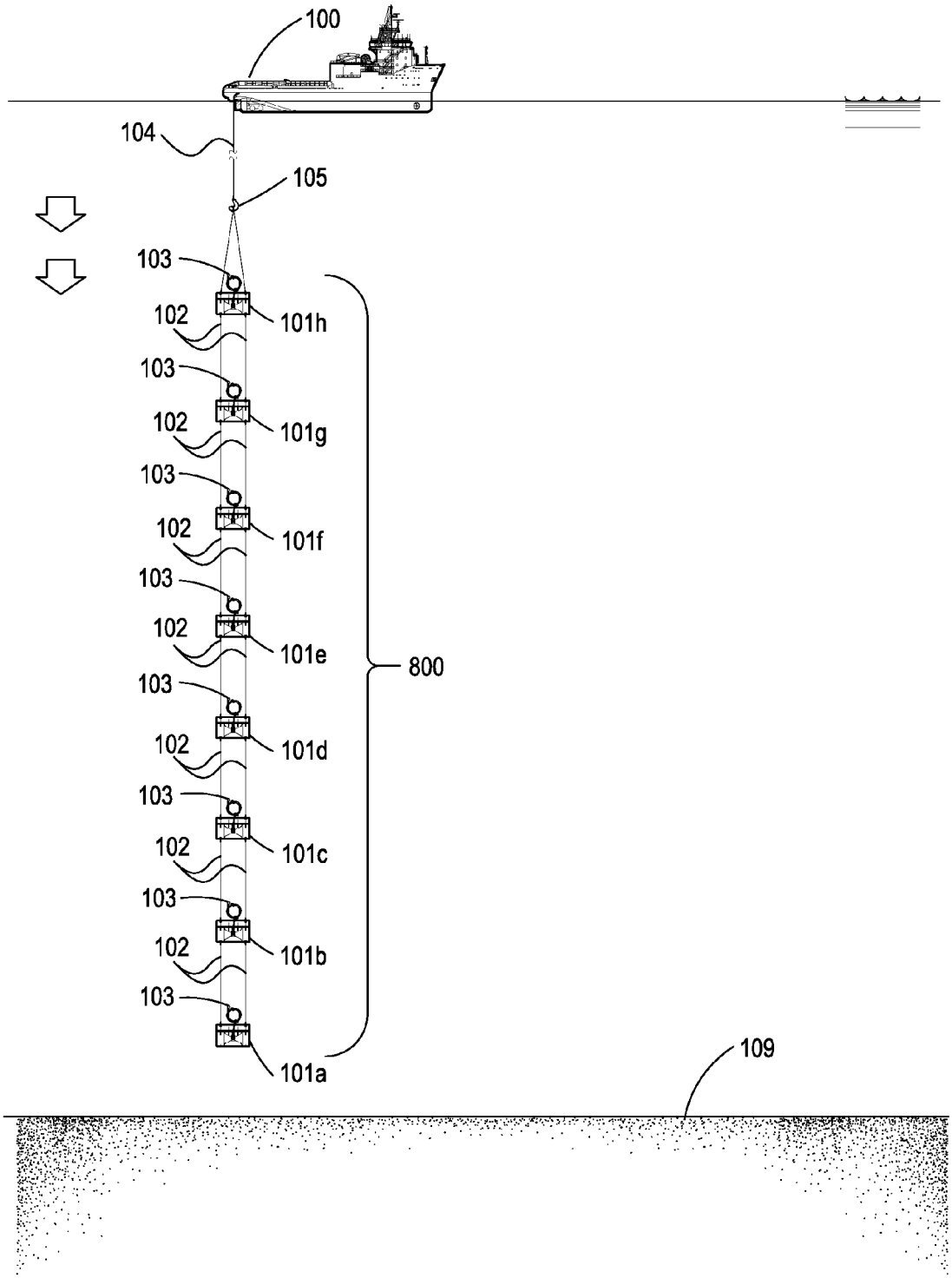
FIG. 8A illustrates an assembled linked anchor assembly that has been deployed into the water and suspended from an AHV according to one exemplary embodiment of the disclosed systems and methods.
Figure 8B:
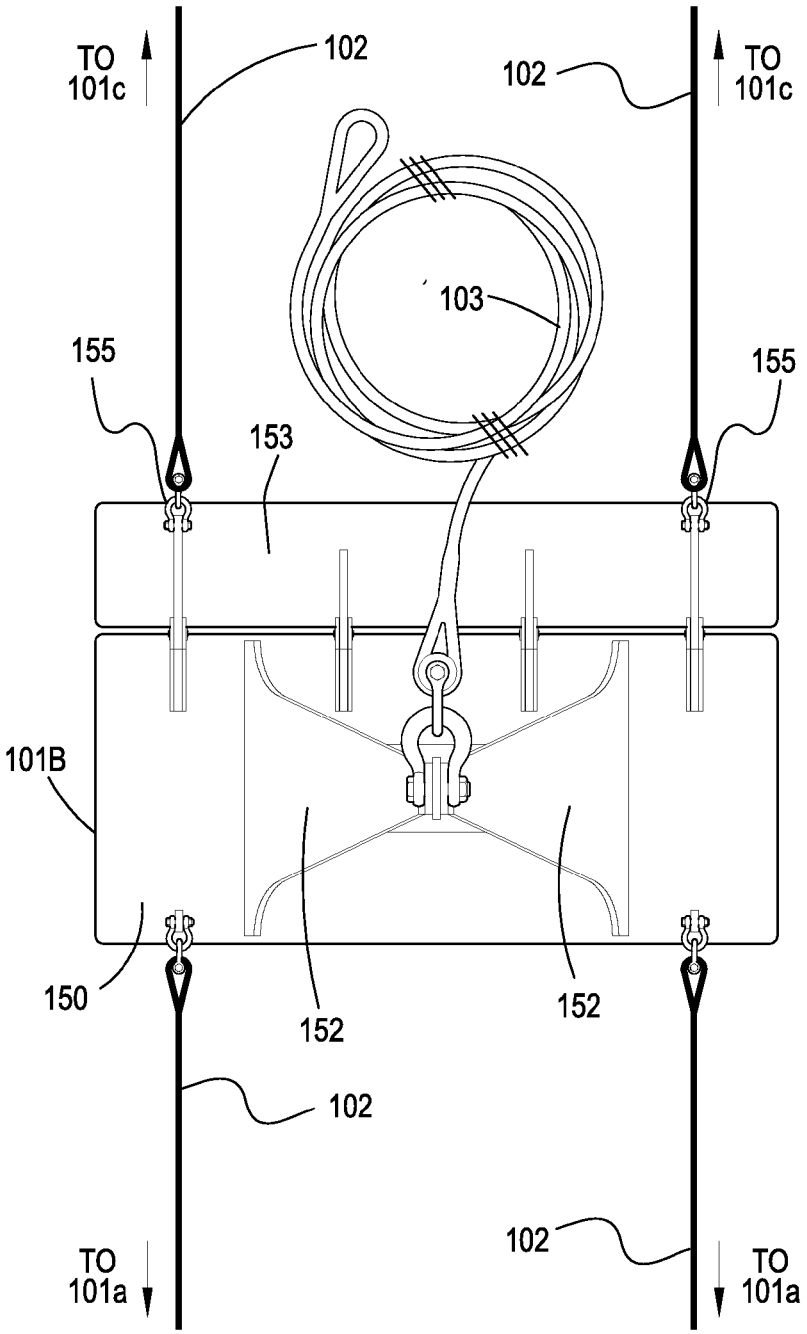
FIG. 8B illustrates a detailed view of one of the anchors of linked anchor assembly according to one exemplary embodiment of the disclosed systems and methods.

FIG. 8A shows a completely assembled linked anchor assembly 800 of eight anchors that has been deployed into the water from AHV 100. As shown, all eight stowed anchors 101 of FIG. 5 have now been added to the linked anchor assembly in a manner as described above. In the illustrated configuration of FIG. 8A, linked anchor assembly 800 includes plate anchors 101*a* to 101*h* that are linked together by respective recovery pendants 102 and suspended from AHV 100 by J-hook 105 and work wire 104. In FIG. 8A, linked anchor assembly 800 has been lowered into the water from AHV 100 using aft winch 108 to a distance of about 500 feet above seafloor 109 or other suitable distance. As further shown, anchor 101*a* is the terminal (end) anchor of the linked anchor assembly 800, and is therefore in queue to be the first anchor to be deployed on the seafloor. FIG. 8B illustrates a detailed view of anchor 101*b* of linked anchor assembly 800.

Figure 9A:
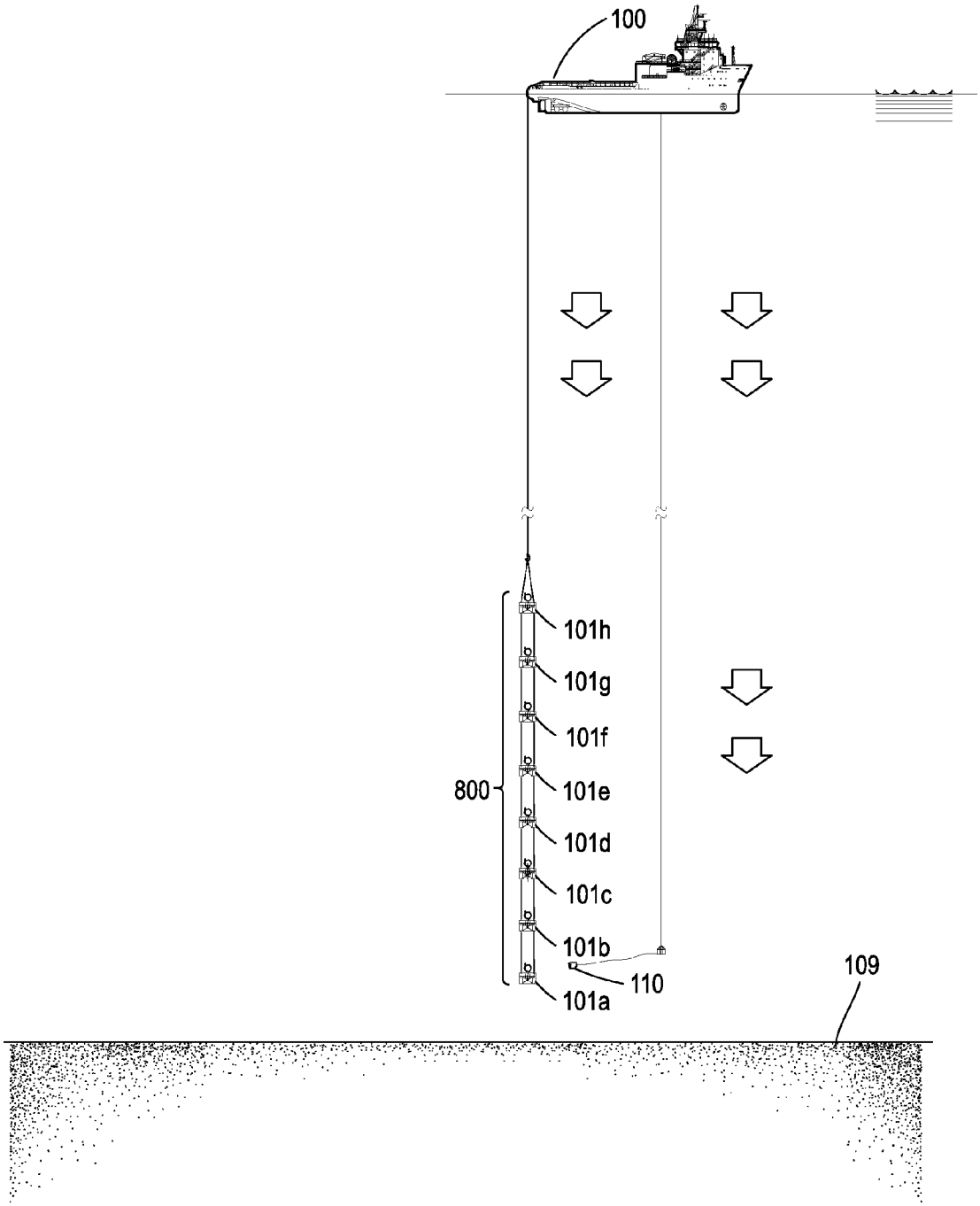
FIG. 9A illustrates lowering of the linked anchor assembly toward the seafloor according to one exemplary embodiment of the disclosed systems and methods.
Figure 9B:
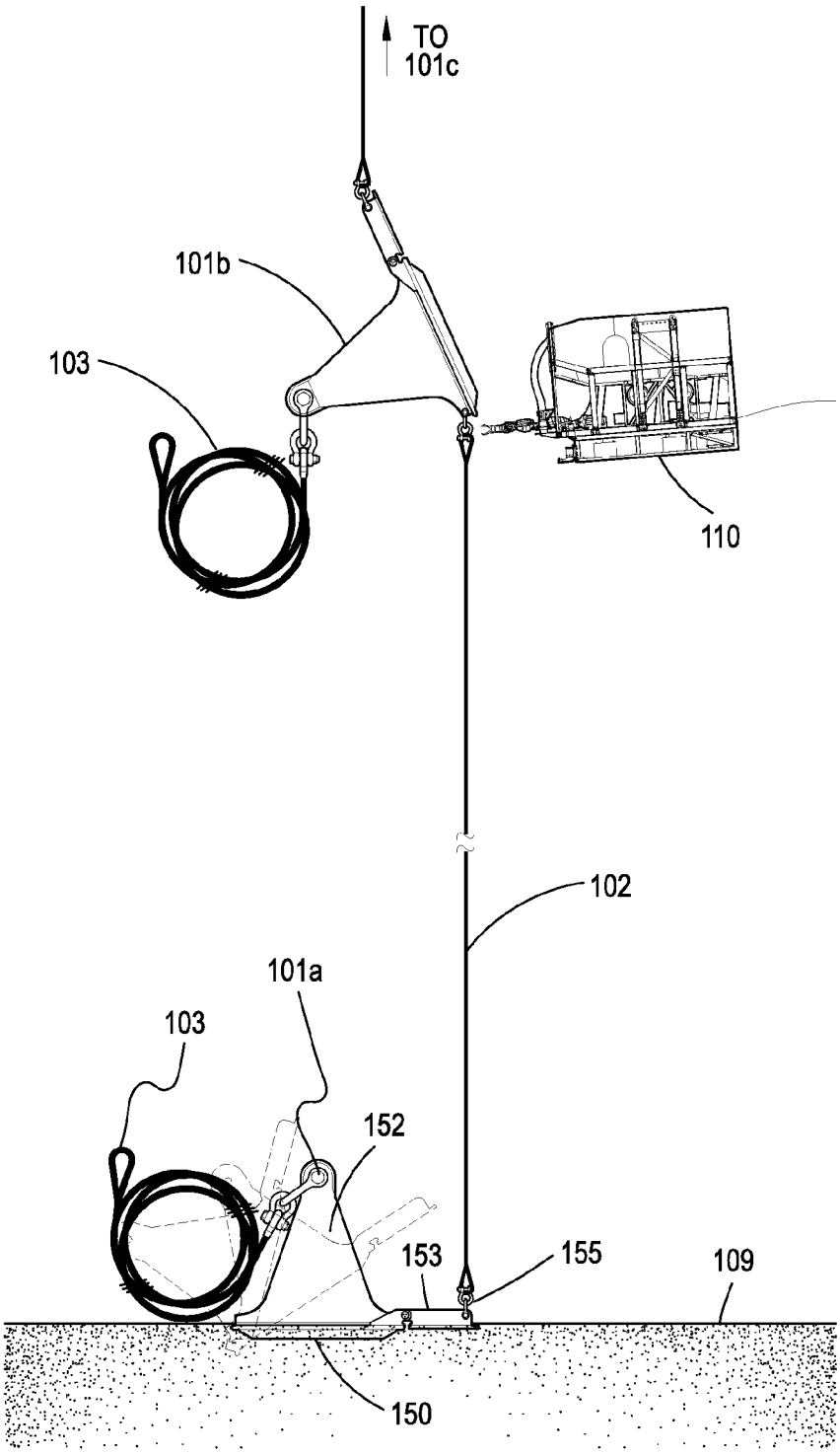
FIG. 9B illustrates disconnection of the recovery pendants of a first anchor from a second anchor according to one exemplary embodiment of the disclosed systems and methods.

FIGS. 9A and 9B show first plate anchor 101*a* being placed on the seafloor 109 by the AHV 100, e.g., after confirming the location is correct. In FIG. 9A, linked anchor assembly 800 has been further lowered into the water by the AHV to a distance of about 100 feet above seafloor 109. As shown in FIG. 9B, linked anchor assembly 800 has been further lowered into the water by the AHV 100 so that the flat surface of fluke 150 of plate anchor 101*a* is placed on seafloor 109 with shank 152 oriented upwards and keying flap 153 extending horizontally outward in substantially parallel relationship with seafloor 109. In this embodiment, the ROV 110 approaches and disconnects the recovery pendants 102 from fluke 150 of second anchor 101*b*.

Figure 10A:
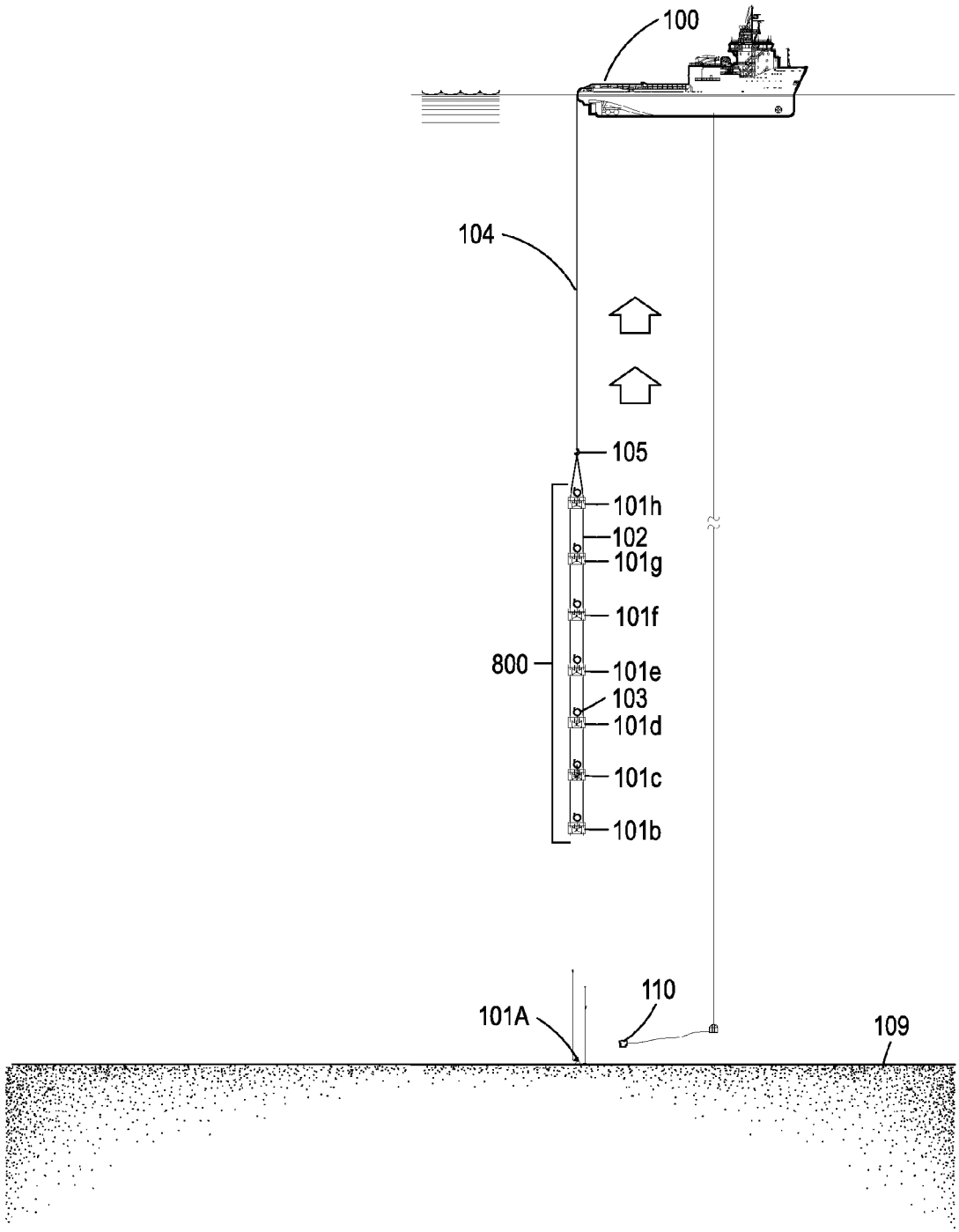
FIG. 10A illustrates raising the remaining anchors of a linked anchor assembly for movement to the next desired anchor placement location according to one exemplary embodiment of the disclosed systems and methods.

In FIG. 10A, the workwire 104 is raised from the seafloor with the remainder of linked-together anchors 101*b*-101*h* toward AHV 100 and moved to the next desired location for placement on the seafloor 109 of the next (second) anchor 101*b*, which may in one embodiment be done without again raising the linked anchor assembly 800 to the surface of the water, e.g., the linked anchor assembly 800 may only be raised above the seafloor 109 by a nominal distance (and not to the sea surface) before moving to the next location for plate anchor deployment while the linked anchor assembly 800 is suspended from the AHV 100 on work wire 104. In this way individual anchors 101 may be sequentially decoupled from each other underwater and deployed in separate different locations on the seafloor, and in one embodiment without again raising the anchor link assembly 800 to the sea surface.

Figure 10B:
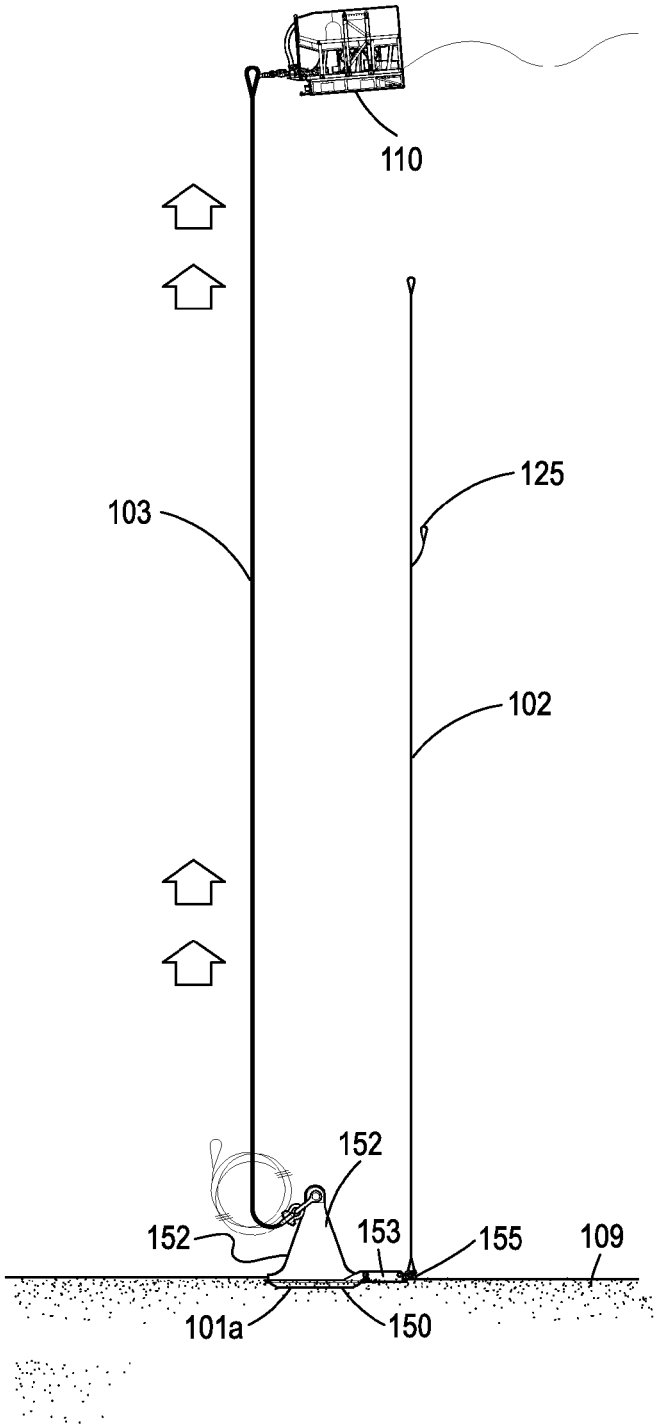
FIG. 10B shows use of a ROV to deploy a mooring pendant of the first plate anchor from its previously coiled configuration according to one exemplary embodiment of the disclosed systems and methods.

Referring to both FIGS. 10A and 10B, ROV 110 approaches and deploys the mooring pendant 103 of first anchor 101*a* from its previously coiled configuration. As shown, recovery pendants 102 are floating, as are mooring pendants 103 of each plate anchor 101. As before, a Yale grip 125 may be provided on the recovery pendants 102 for the purpose of pulling the plate anchor 101 into the suction follower 111's slot 194 while allowing the floating free ends of the recovery pendants to remain clear of the seafloor 109. In FIG. 10A, the next anchor (second plate anchor 101*b*) is now the terminal or end anchor of the linked anchor assembly, and is thus the next anchor 101 in queued position for detachment and deployment. Thus, it will be understood that the process of FIGS. 9-10 may be repeated for each successive terminal linked anchor 101*b*-101*h* of linked anchor assembly 800 until all anchors 101 of assembly 800 have been deployed by AHV 100 in the desired spaced relationship from each other on seafloor 109. It will be understood, however, that not all anchors 101 of assembly 800 need ultimately be deployed, e.g., in a case where anchor deployment plans change during the anchor deployment operation, where mechanical problems or weather require termination of the anchor deployment operation, etc.

FIGS. 11-24 illustrate an exemplary embodiment for rigging, deployment and use of a suction follower 111 to embed one or more anchors 101 that have been previously placed on the seafloor 109, e.g., in one of the manners described above, or using any other technique suitable for placing one or more anchors 101 on the seafloor 109. Thus, the methodology described and illustrated in relation to FIGS. 11-24 may be employed to use a suction follower 111 to sequentially install each of multiple anchors 101 that have been placed on the seafloor 109 using any suitable methodology, e.g., such as either the methodology of FIGS. 1-4 or the methodology of FIGS. 5-10.

Figure 11:
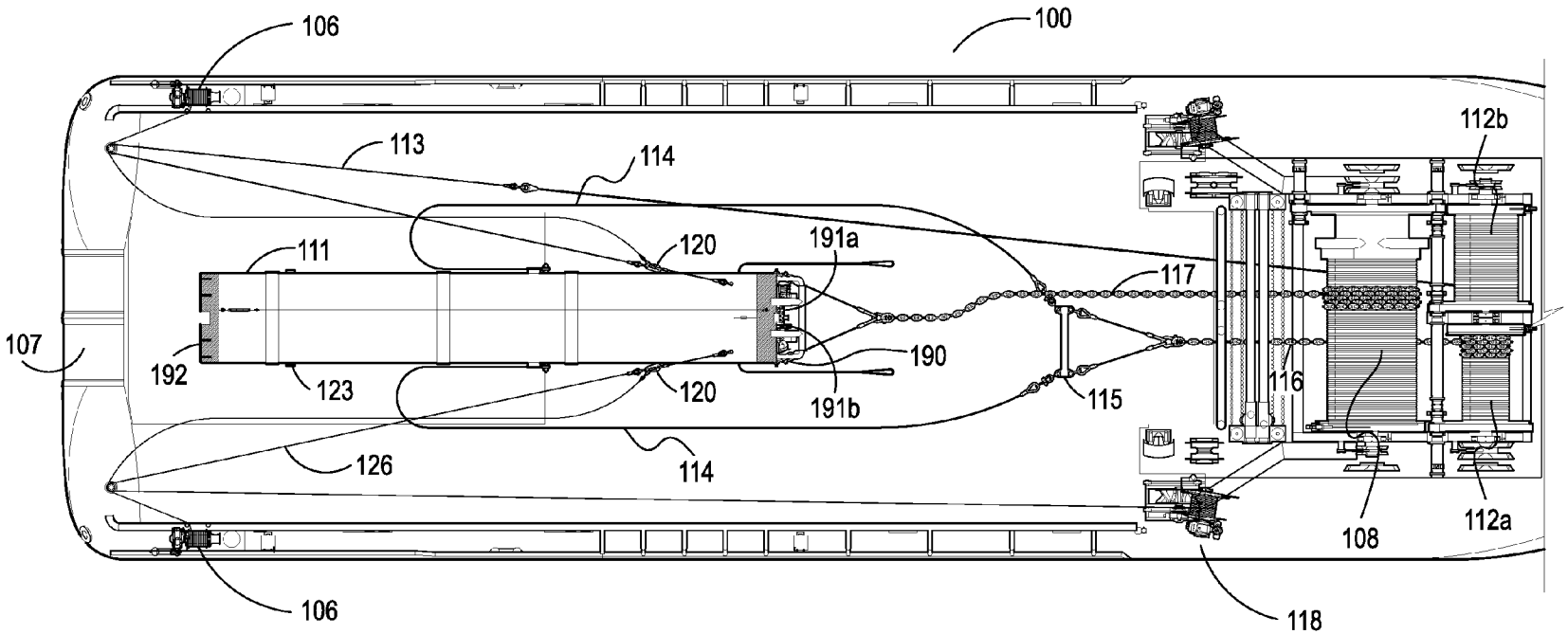
FIG. 11 illustrates the configuration of the suction follower on the deck of the AHV after all plate anchors have been batch-set according to one exemplary embodiment of the disclosed systems and methods.
Figure 12:
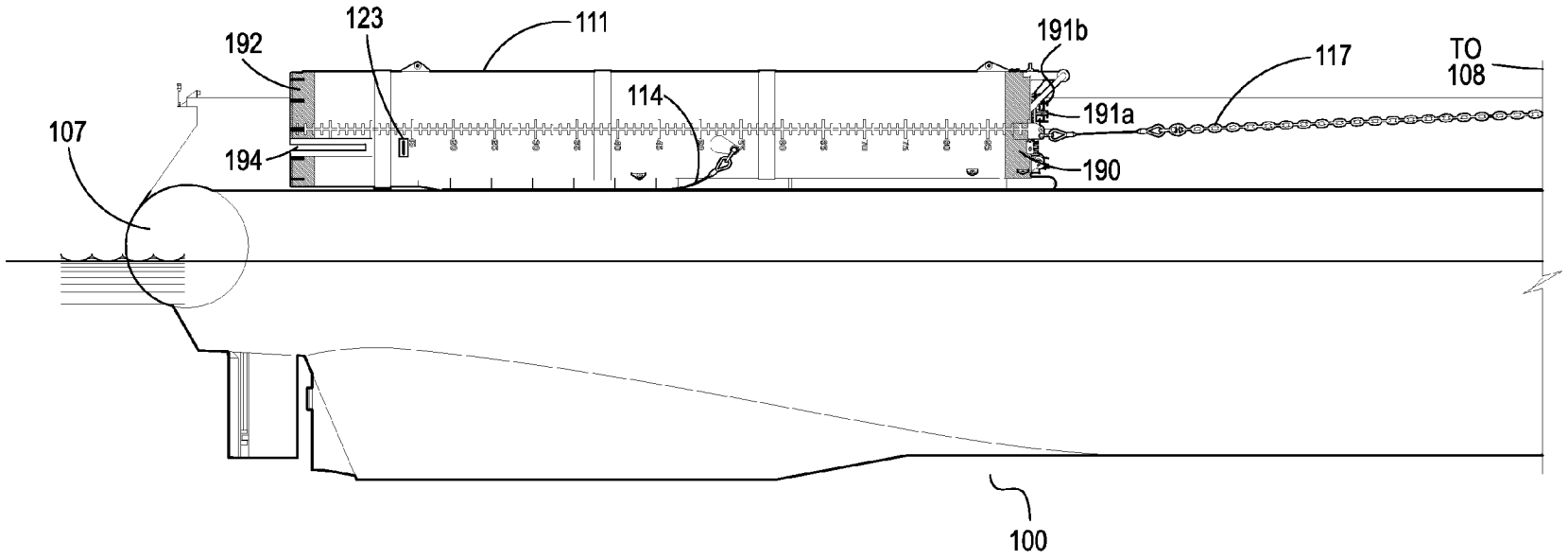
FIG. 12 shows an elevation view of the suction follower on the AHV that illustrates the required rigging according to one exemplary embodiment of the disclosed systems and methods.

FIG. 11 illustrates the rigging configuration of the suction follower 111 according to one exemplary embodiment. In this embodiment, the follower 111 will be deployed over the stern roller 107 in a controlled manner. The follower 111 is pulled aft by lines 113 and 126 connected to the forward tow drum 112B and forward deck winch 118, respectively in this embodiment. The aft deck winches 106 are connected to pullback hooks 120 on lines 113 and 126 near the follower 111 top end. Other rigging illustrated are the so-called hip slings 114 connected to the forward tow drum 112A via line 116 and the spreader bar arrangement 115. In this embodiment, the recovery line 117 is connected to a proximal end (top) 190 of the follower 111 via a bridle arrangement; the bitter end on the line is wound on the aft anchor winch 108. FIG. 12 shows an elevation view of the rigging arrangement. Once the rigging is ready and the AHV 100 is over the target location, the seafastenings to the follower 111 are removed.

Figure 13A:
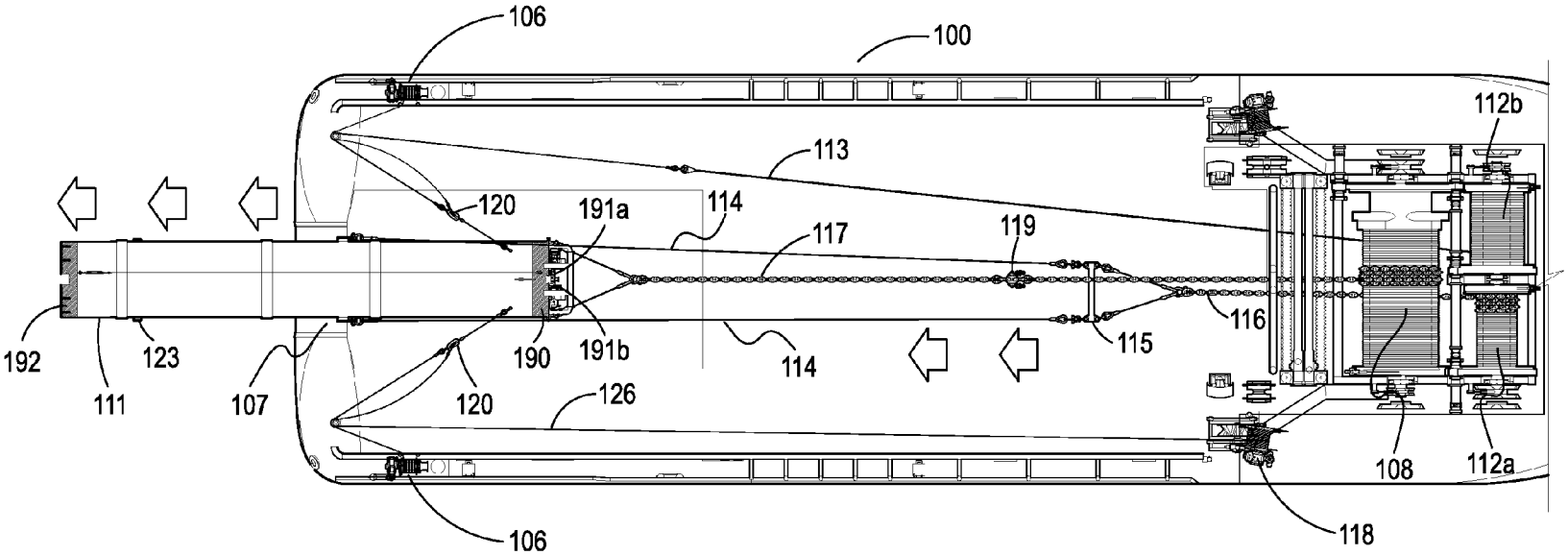
FIG. 13A illustrates an overhead view of a method of deploying the suction follower according to one exemplary embodiment of the disclosed systems and methods.
Figure 13B:
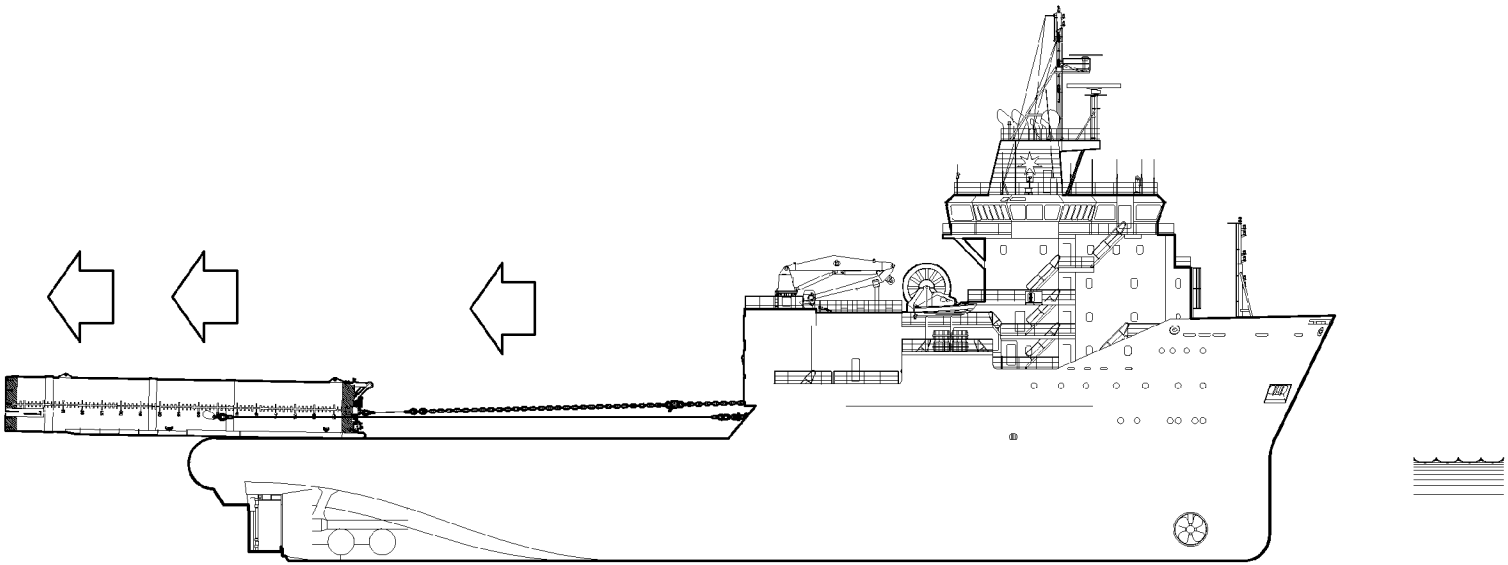
FIG. 13B illustrates a side view corresponding to the overhead view of FIG. 13A showing a method of deploying the suction follower according to one exemplary embodiment of the disclosed systems and methods.
Figure 14:
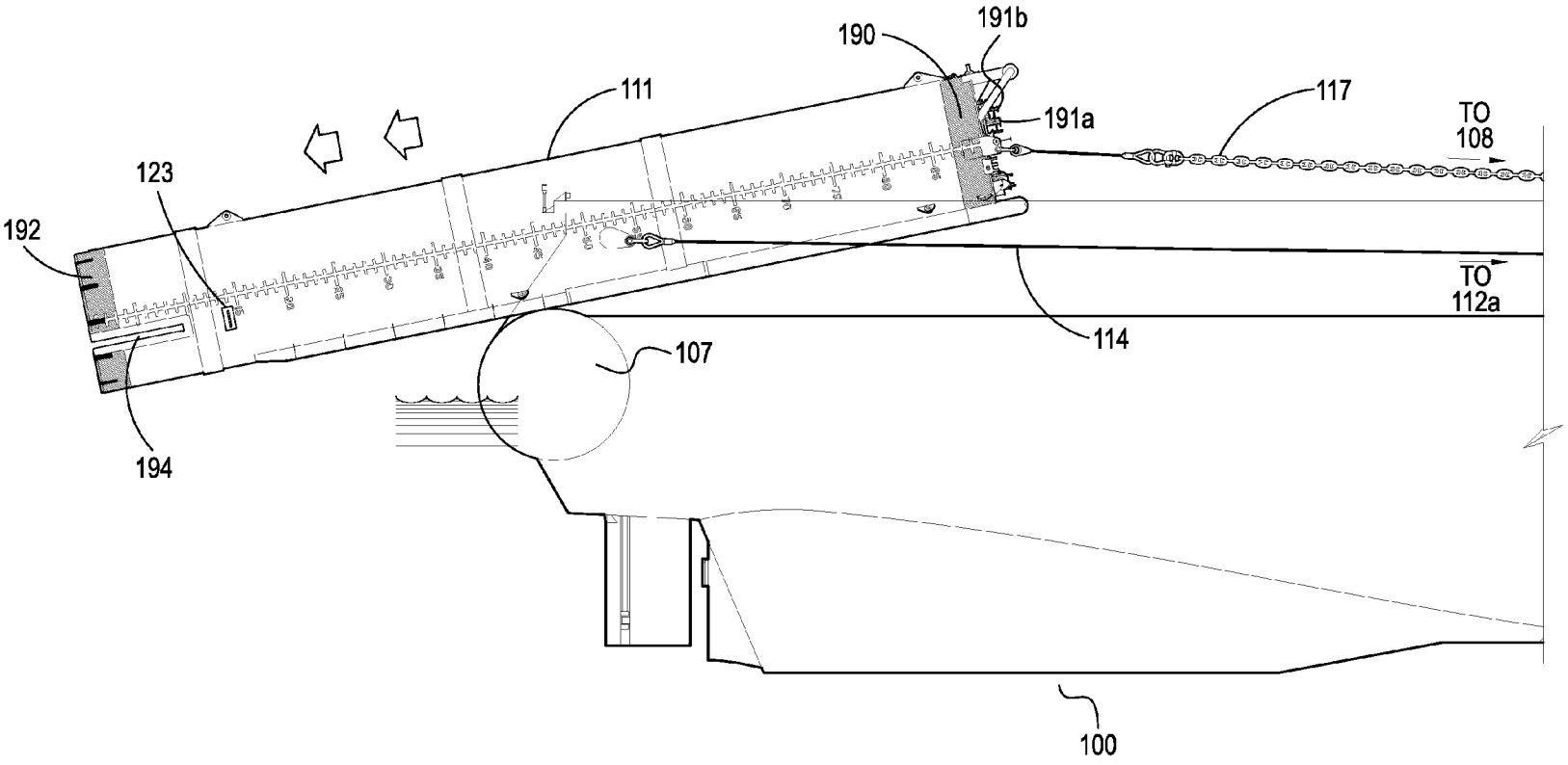
FIG. 14 illustrates additional steps to deploy the suction follower according to one exemplary embodiment of the disclosed systems and methods.
Figure 15:
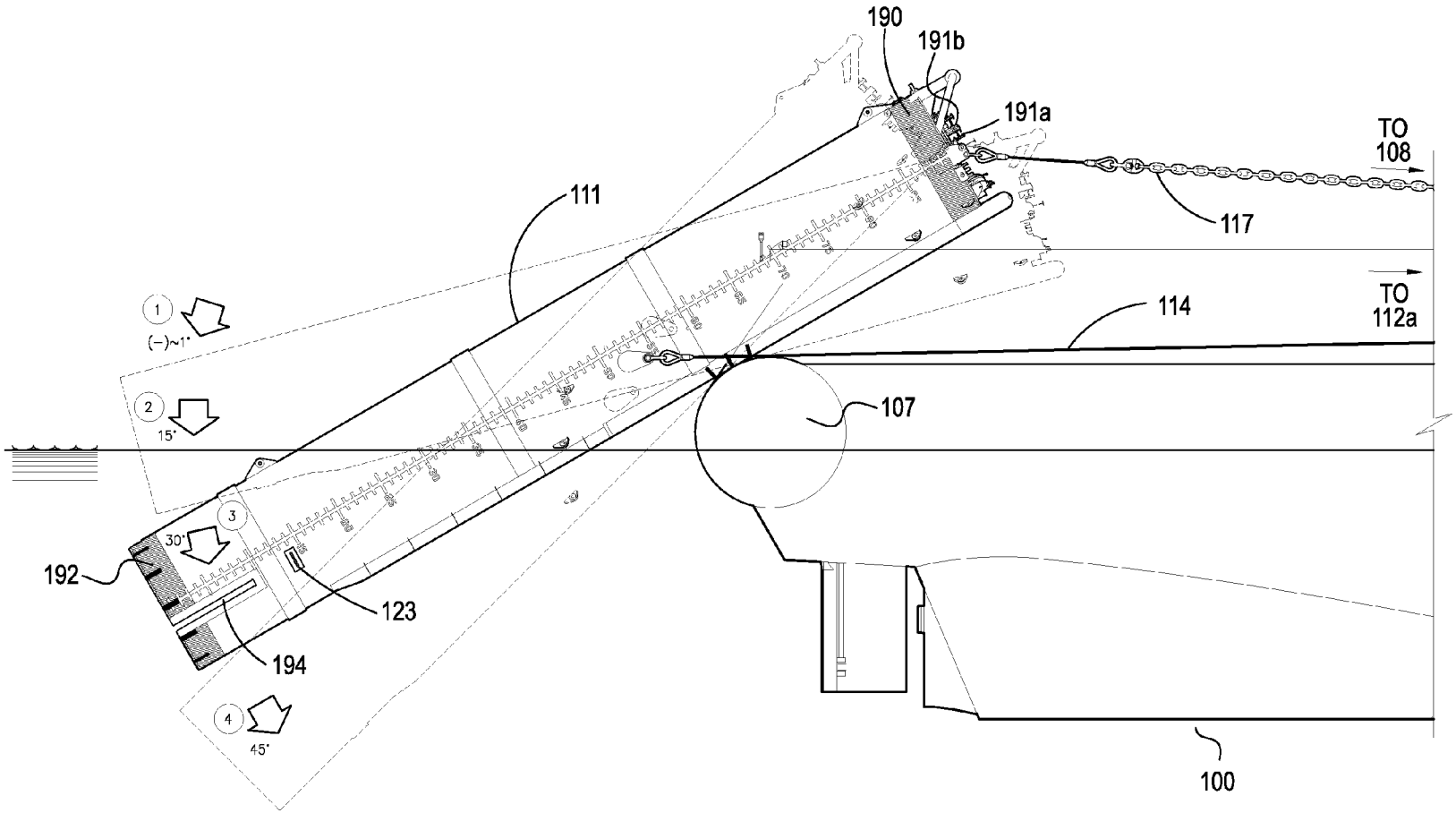
FIG. 15 illustrates additional steps to deploy the suction follower according to one exemplary embodiment of the disclosed systems and methods.
Figure 16:
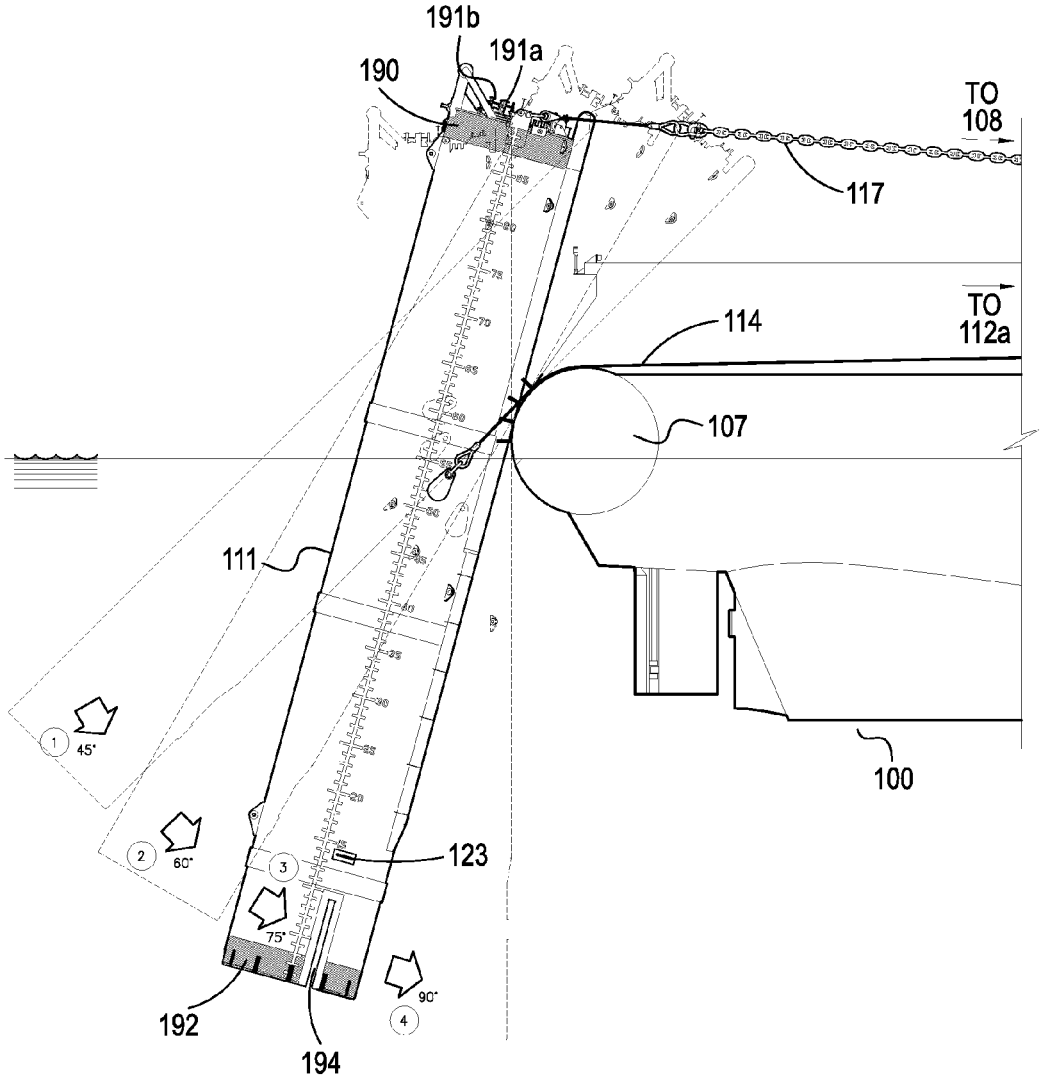
FIG. 16 illustrates additional steps to deploy the suction follower according to another exemplary embodiment of the disclosed systems and methods.
Figure 17:
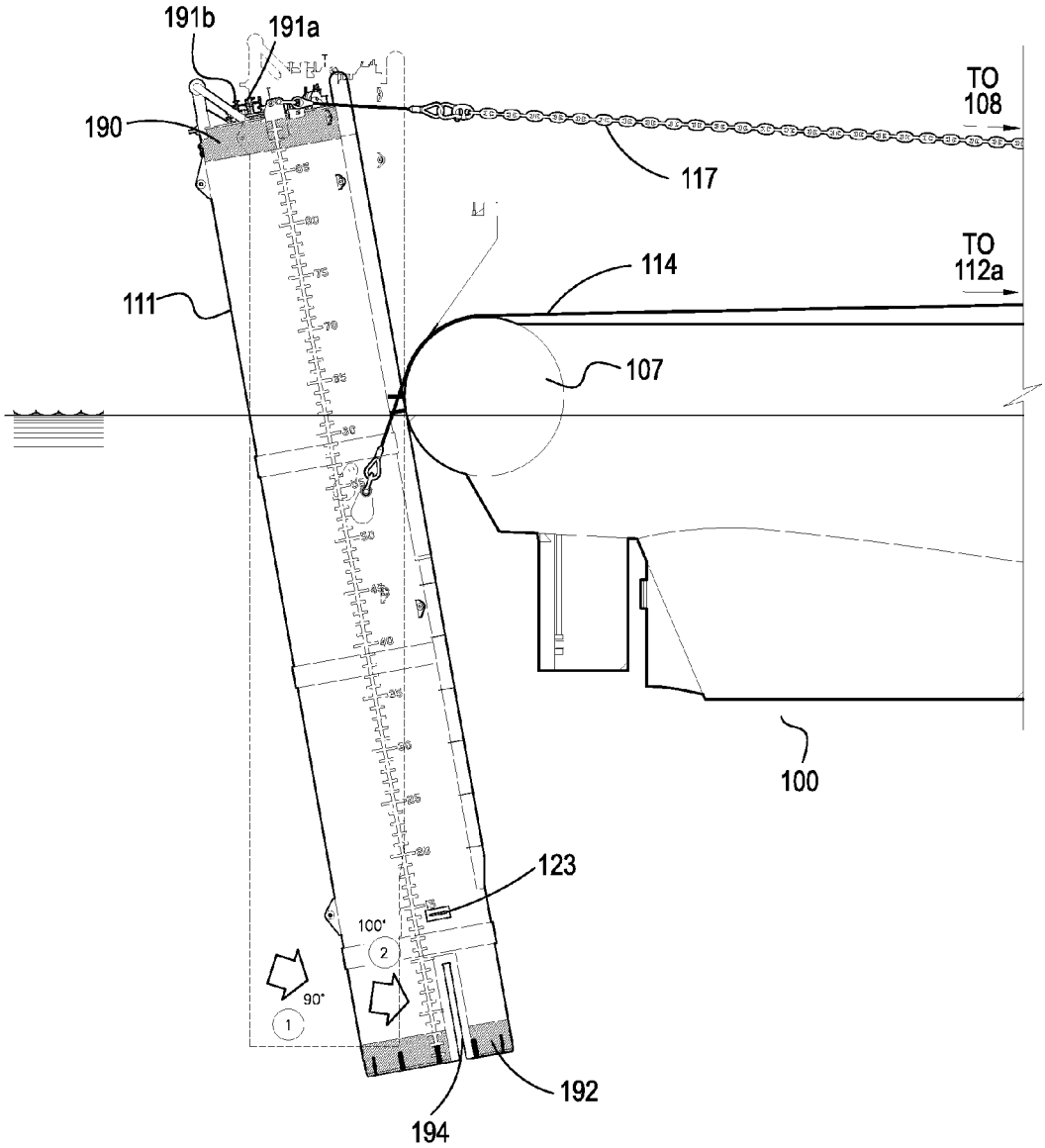
FIG. 17 illustrates the final step to deploy the suction follower according to one exemplary embodiment of the disclosed systems and methods.

FIGS. 13A and 13B show the initial steps to deploy the follower wherein lines 113 and 126 are tensioned to pull the follower 111 aft while recovery line 117 provides backtension to ensure controlled movement of the follower 111. The hip slings 114 are kept taut in anticipation of resisting the vertical load component of the follow as it tips over the stern roller 107. Once the center of gravity of the follower 111 is aft of the stern roller 107 and the follower 111 rotates, the pullback hooks 120 are tripped by deck winches 106, releasing the pullback lines 113 and 126. FIG. 14 shows an elevation view of the follower 111 being deployed over the stern roller 107 in an early stage of the process. FIG. 15 shows the deployment as the follower angle reaches approximately 35 deg and the hip slings start to resist the dead load of the follower 111. FIG. 16 shows the follower 111 between 45 deg and 90 deg when the hip slings become fully taut at about 60 deg. In the final stage shown in FIG. 17, the AHV's 100 dynamic positioning system (DP) is shut down aft to reduce propeller wash effects on the follower 111 and the lowering line 117 slackened to rotate the follower 111 to approximately 98 deg while maintaining follower 111 stickup above the stern roller 107 at approximately 30% of the follower's 111 length. Next, lines 117 and 114 are paid out simultaneously lowering the follower 111 past the stern roller 107; as the follower top passes the stern roller 107, all the load is transferred to the hip slings 114. After the lowering line bridle on line 117 is completely submerged, the load is slowly transferred to the lowering line 117 in full. Lowering continues until the follower top is approximately 50 ft below the stern roller 107 or other suitable clearance distance below the stern roller 107.

Figure 18A:
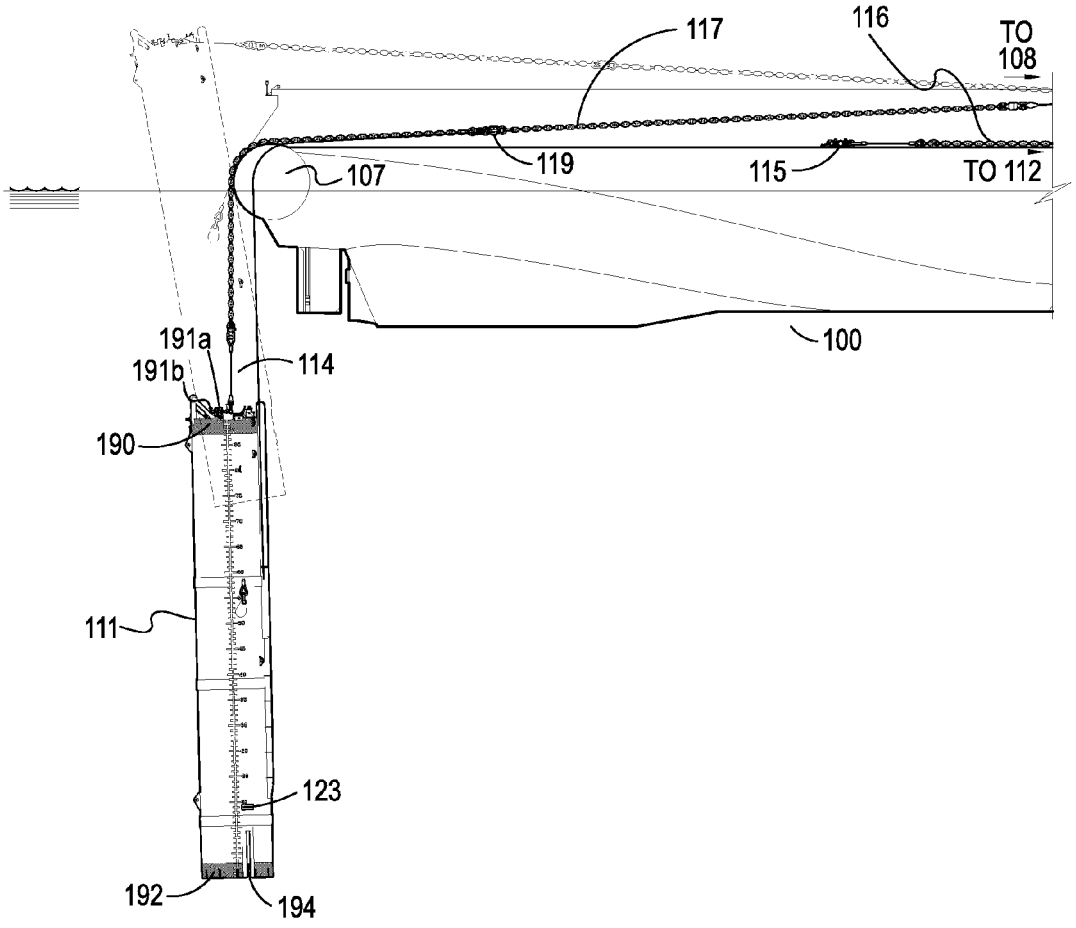
FIG. 18A illustrates a side view of the reconfiguration of the suction follower for lowering to the seafloor according to one exemplary embodiment of the disclosed systems and methods.
Figure 18B:
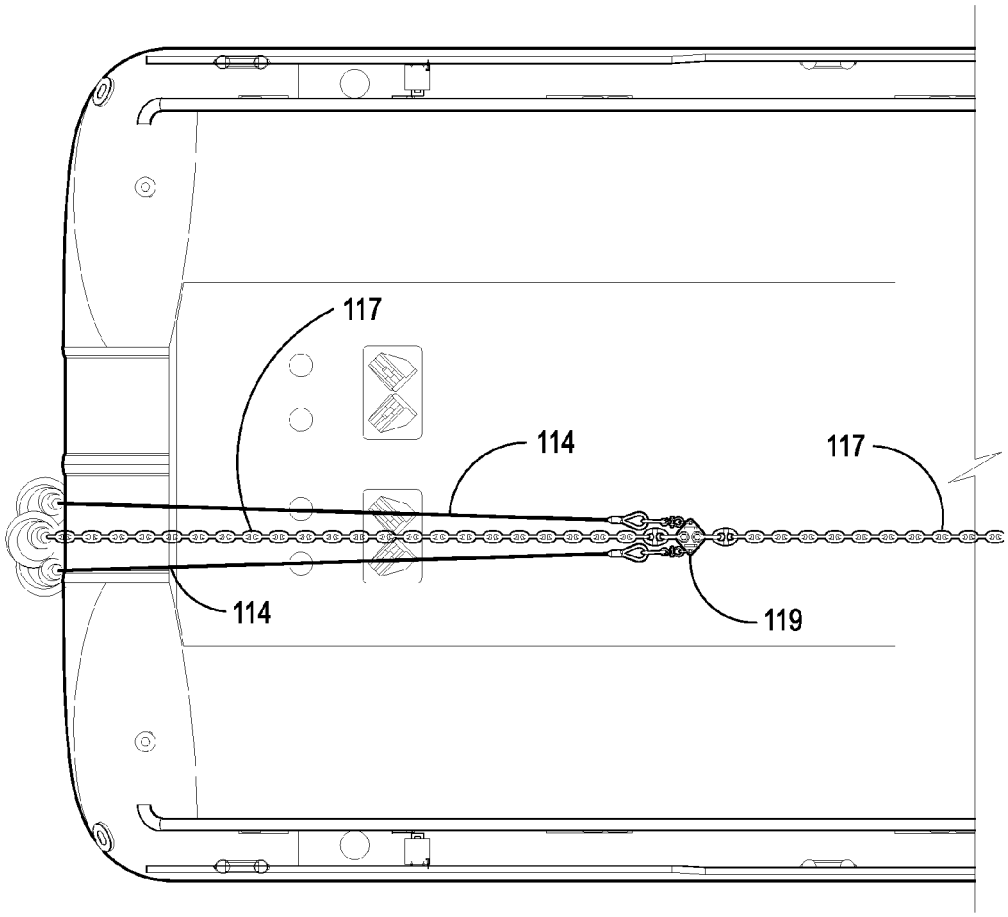
FIG. 18B illustrates an overhead view corresponding to the side view of FIG. 18A showing the reconfiguration of the suction follower for lowering to the seafloor according to one exemplary embodiment of the disclosed systems and methods.
Figure 19A:
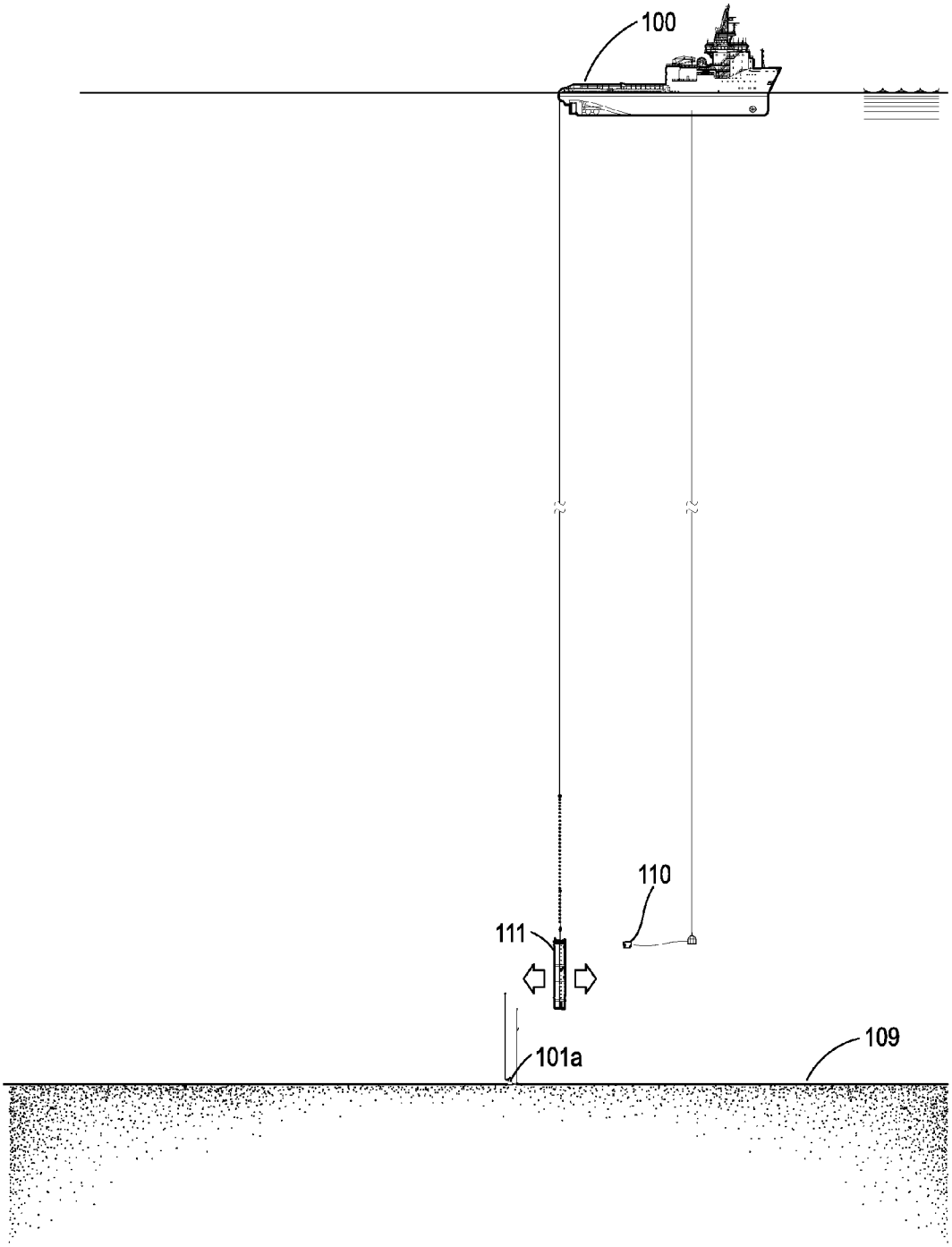
FIGS. 19A and 19B show the suction follower being lowered near the seafloor and orientation and location being confirmed according to one exemplary embodiment of the disclosed systems and methods.
Figure 19B:
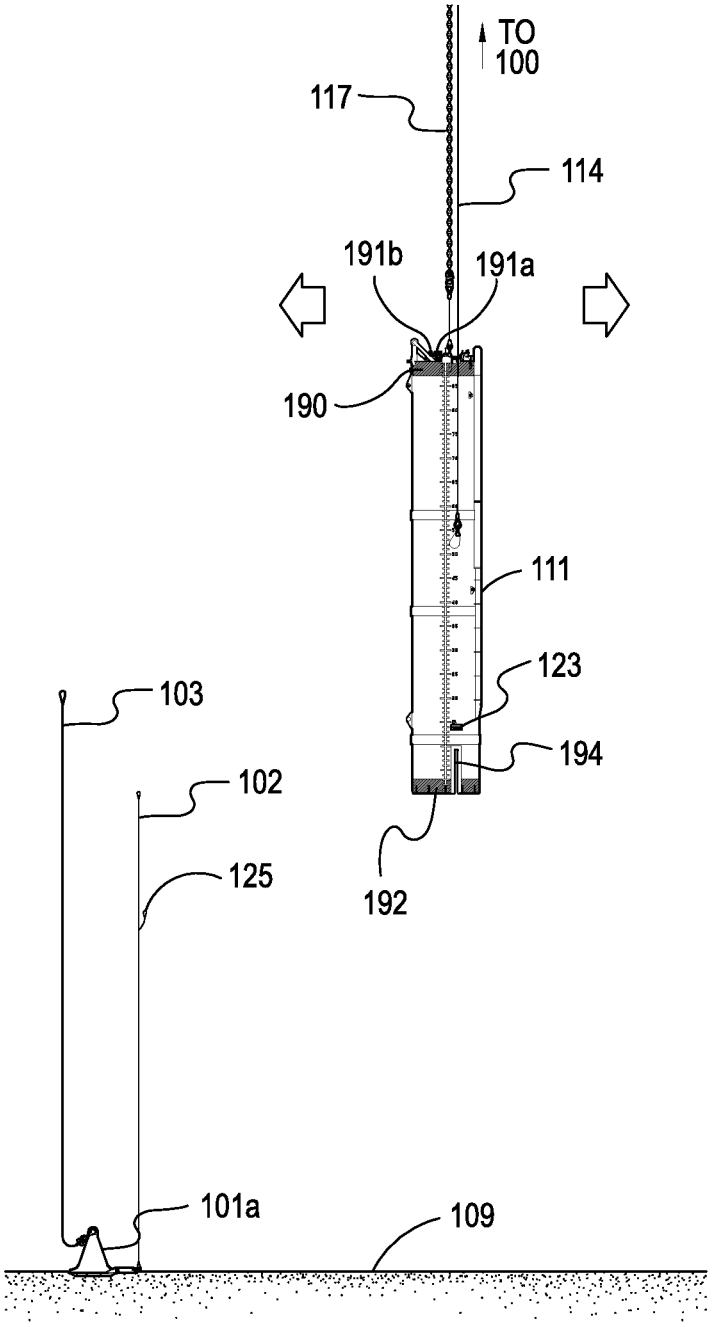
Figure 20A:
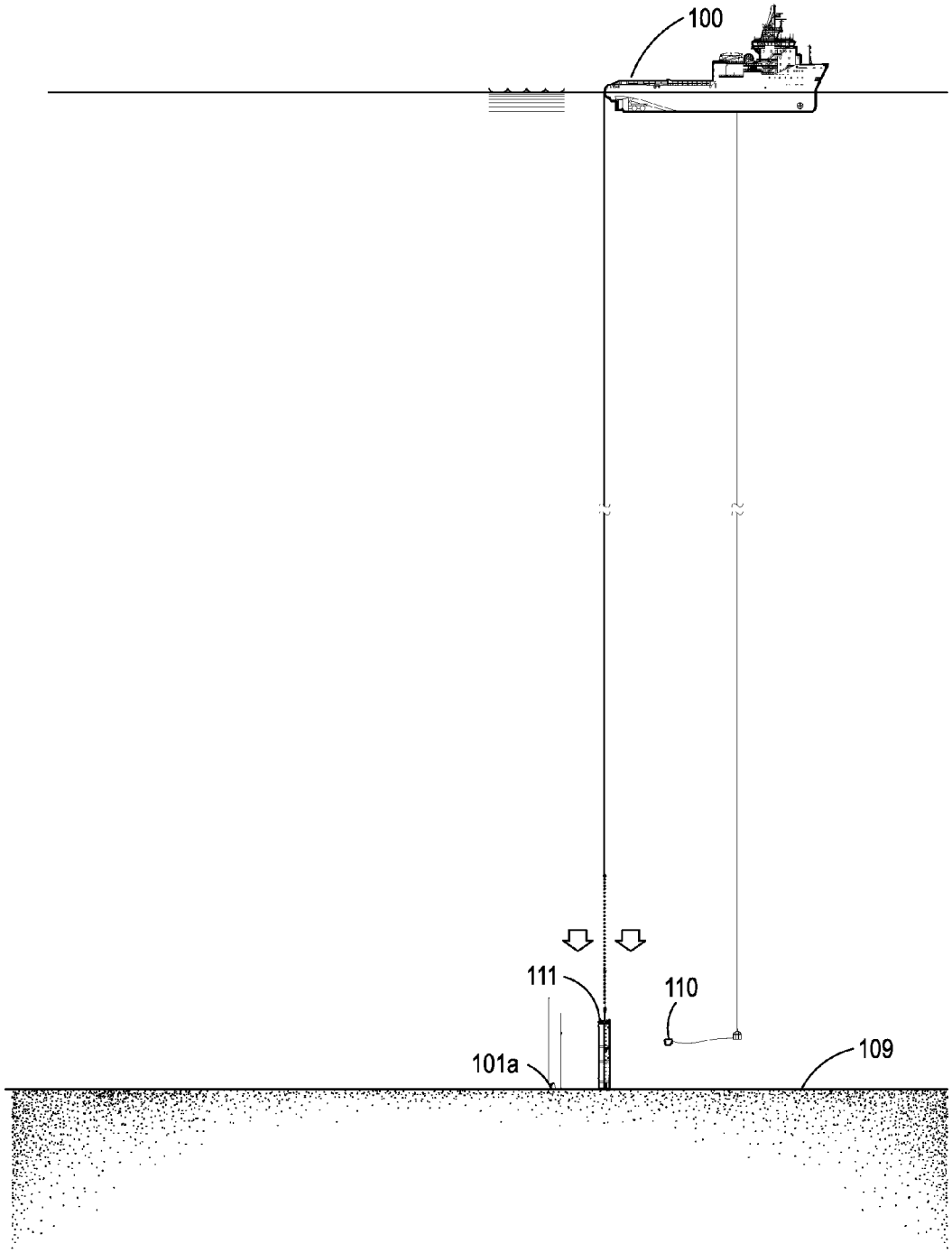
FIGS. 20A and 20B show the suction follower being lowered to the seafloor approximately 50 ft from the pre-positioned plate anchor and allowed to penetrate until it stops rotating about its longitudinal axis according to one exemplary embodiment of the disclosed systems and methods.
Figure 20B:
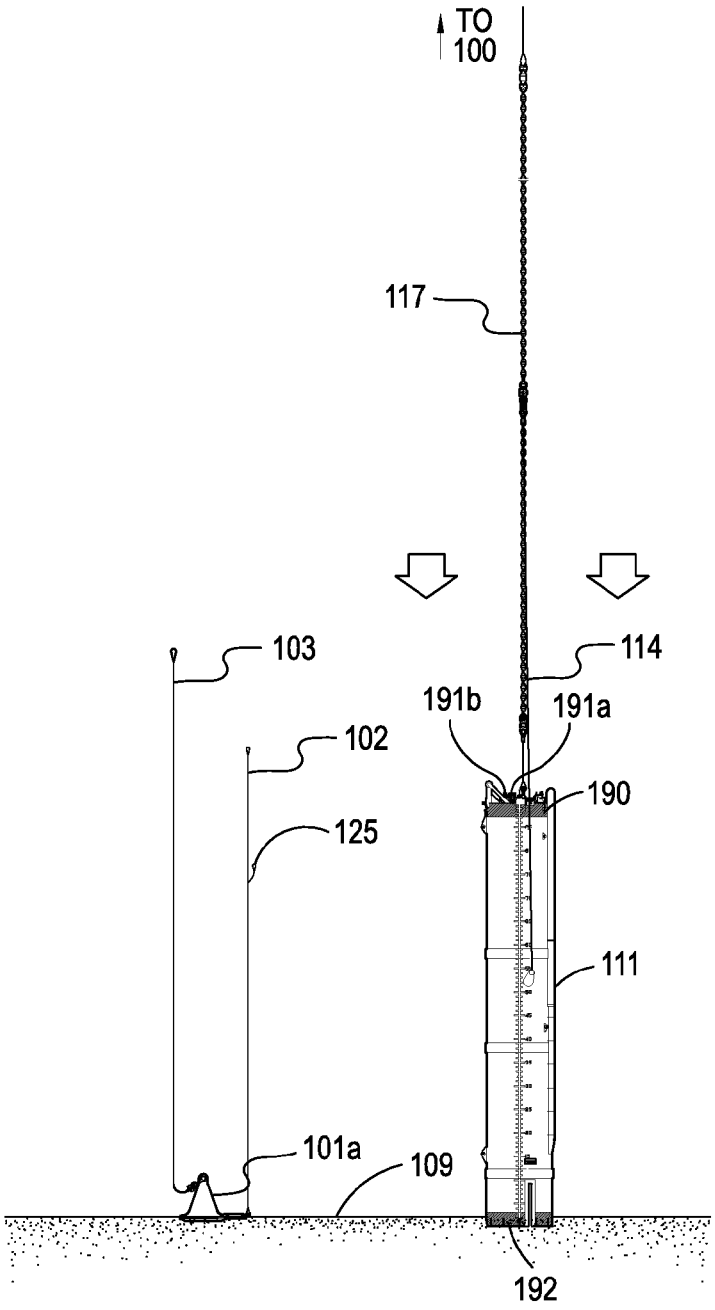

With all of the follower 111 load on the lowering line 117 as shown in FIGS. 18A and 18B, the hip slings 114 are slacked off and disconnected from the spreader bar 115 and connected to the quad plate 119. As shown in FIGS. 19A and 19B, the AHV 100 lowers the follower 111 until it is approximately 100 ft or other suitable distance above the seafloor 109 and near the plate anchor 101 to be embedded. While AHV 100 maintains position, the ROV 110 confirms the orientation of the follower 111 is correct, e.g., by observing orientation lines on top of follower 111. Once the final location of follower 111 is determined and the orientation of follower 111 is confirmed, the follower 111 is lowered until it embeds in the seafloor 109 a sufficient distance to stop rotating about its longitudinal axis (e.g., about 2 ft or other suitable distance) as shown in FIGS. 20A and 20B. At this time the follower 111 is approximately 50 ft or other suitable distance from the plate anchor 101. The two circle hooks 121 are deployed from their storage positions on the follower top 190 and are positioned in the lower guides 123 by the ROV 110.

Figure 21:
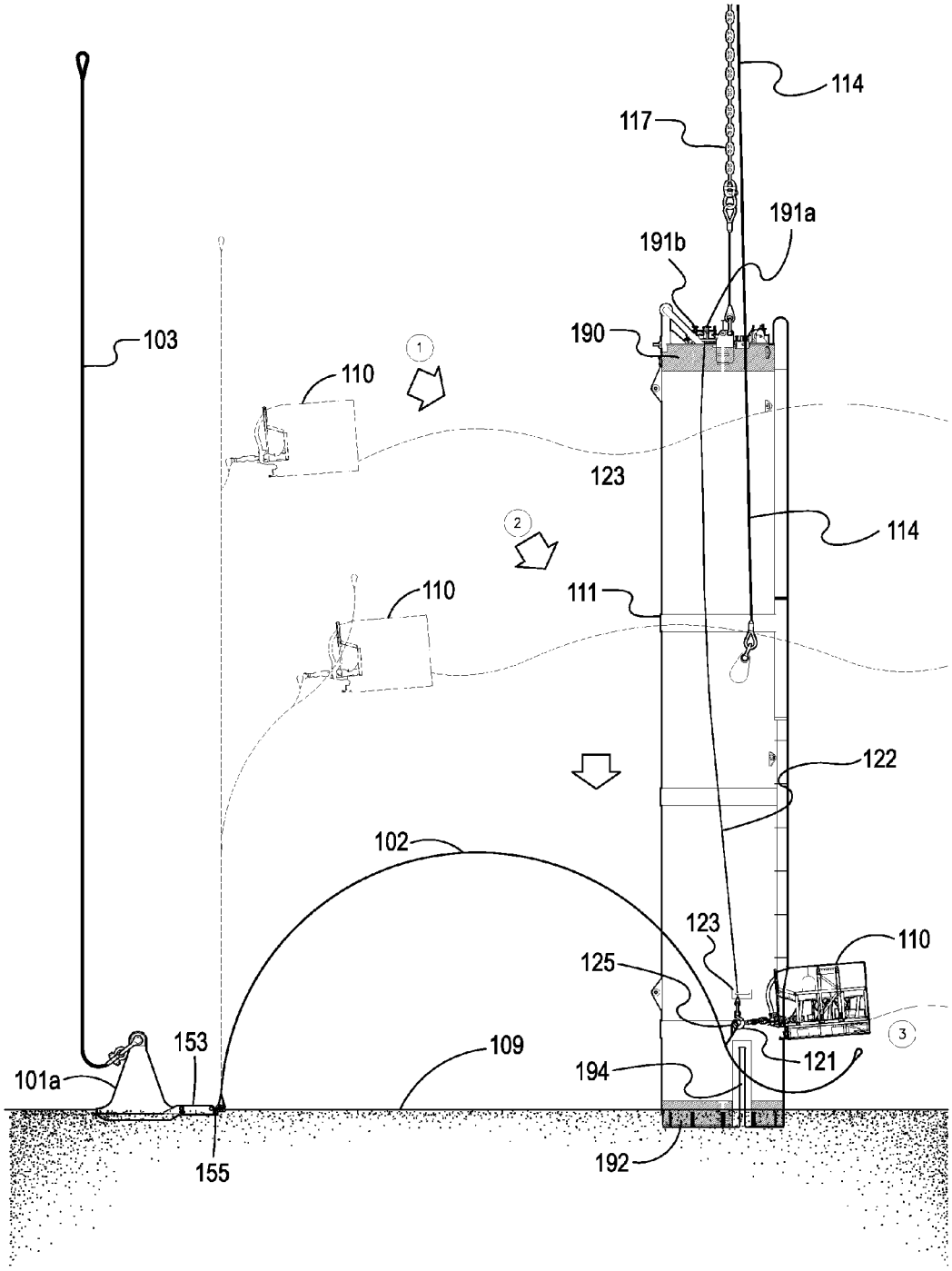
FIG. 21 illustrates the connection of the recovery pendants to the circle hooks on the sides of the suction follower by the remote operated vehicle (ROV) according to one exemplary embodiment of the disclosed systems and methods.

FIG. 21 shows the ROV 110 connecting the Yale grips 125 on the floating recovery pendants 102 (two each in this exemplary embodiment) to the circle hooks 121. The circle hooks 121 are connected to the ends of the integral follower top winches 191 via the winch lines 122 (e.g., wires or other suitable type of retrieval line). In one embodiment, two top winches 191 may be provided at the proximal (top) end of follower 111 to actuate the two winch lines 122 that are present on opposing sides of follower 111, although a single dual-line winch may be alternatively employed to support two such winch lines 122. FIG. 21 illustrates a side view of a suction follower 111 having two such top winches 191*a* and 191*b* disposed on its proximal end.

As described further herein, two such winch lines 122 may be coupled (e.g., by ROV 110) to two respective recovery pendants 102 that are in turn attached to spaced-apart coupling points 155 located near the respective opposing ends of keying flap 153 of a given plate anchor 101. The spacing between the keying flap coupling points 155 may be at least as wide as the outer diameter of the suction follower 111 in the plane formed between docking slots 194 where the docking slots 194 intersect suction follower 111, and the overall width (side to side) of the keying flap may be wider then the outside diameter of the suction follower 111 in the plane formed between docking slots 194 where the docking slots 194 intersect suction follower 111. In such a configuration, the winch lines 122 may be used to simultaneously retrieve the two recovery pendants 102 coupled near opposing sides of the keying flap 153 of a given plate anchor 101 (e.g., such as the plate anchor 101 illustrated in FIG. 1) so that the plate anchor 101 may be accordingly retrieved simultaneously by its two recovery pendants 102 in proper docking orientation (fluke side down) into the anchor docking slots 194 on the distal end of follower 111, e.g., with keying flap 153 oriented upward toward the sea (water's) surface and with keying flap 153 oriented in a position within the docking slots 194 such that the suction follower 111 is disposed between (e.g., substantially centered between) the coupling points 155 and corresponding recovery pendants 102.

In another possible alternative embodiment, at least one top winch 191 may be provided on proximal end 190 of a suction follower 111, and configured to lower and retrieve at least one interior winch line through a closed top of the suction follower 111, e.g., down through and along the central axis of the interior of the suction follower 111. A stuffing box seal or other seal mechanism may be provided to maintain pressure integrity and hydraulic seal at the point where the interior winch line penetrates the top of the suction follower while the interior winch line moves up and down within the suction follower 111. In this embodiment, the interior winch line may be lowered through the interior of the suction follower 111 and attached to a recovery pendant 102 that itself is coupled at a point at substantially the center of the width of the keying flap 153 of a plate anchor 101 such that the plate anchor 101 may be retrieved by the interior winch line upwards into substantially centered docking engagement with the distal end of the suction follower 111.

Figure 22:
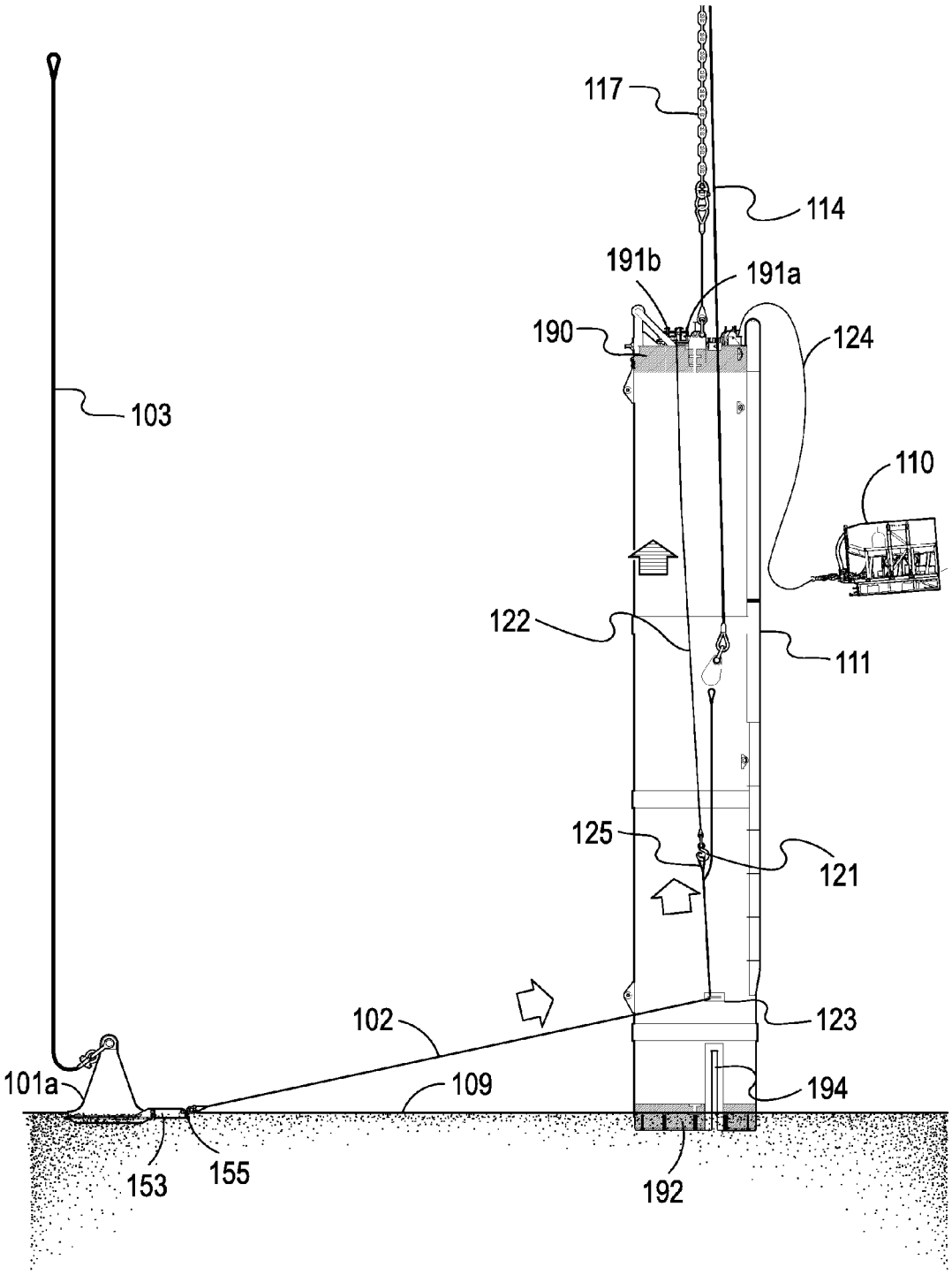
FIG. 22 shows the shows the suction follower winching the plate anchor towards the follower with the assistance of the ROV according to one exemplary embodiment of the disclosed systems and methods.

In one embodiment, one or more top winches 191 may be hydraulically powered with hot-stab capability, although any other suitable type of winches (e.g., electric winches) may be employed. As shown, optional winch line guides 123 may be present to keep the winch lines 122 in the correct orientation for easy passage of the circle hooks 121. In this exemplary embodiment, the circle hooks 121, winch lines 122, winch line guides 123 and top winches 191 together form an integral anchor retrieval mechanism, it being understood that an anchor retrieval mechanism may include any other configuration of one or more components (integral or non-integral to a follower 111) that are suitable for retrieving and/or reorienting a submerged anchor from a position resting on the seafloor into docked arrangement with a follower 111 such as further illustrated an described herein. As shown in FIG. 22, the integral follower top winches 191 tension the winch wires 122, thereby pulling the plate anchor 101 towards the distal end (bottom) 192 of the follower 111. As the plate anchor 101 approaches the follower 111, the follower is raised off the seafloor 109 by the by the aft anchor winch 108 using the recovery line 117 as shown in FIG. 23.

In this embodiment, the ROV 110 uses a combination hotstab and flying lead 124 to provide hydraulic power to the follower top winches 191 although any other technique and/or mechanism for providing suitable anchor retrieval power may be employed including, for example, self-powered integral electric winches, non-integral (e.g., ROV-mounted or sea-surface vessel-mounted) winches, etc. When integral to follower 111, it will be understood that actuators need not be positioned on or near the proximal (top) end of the follower, but may be location otherwise, e.g., such as adjacent the top of anchor docking slots 194 (in which case winch line guides 123 may not be required). Moreover, other types of integral or non-integral actuators may be employed for tensioning or retrieving wires 122 including, for example, hydraulic cylinders integral with follower 111, etc.

Figure 23:
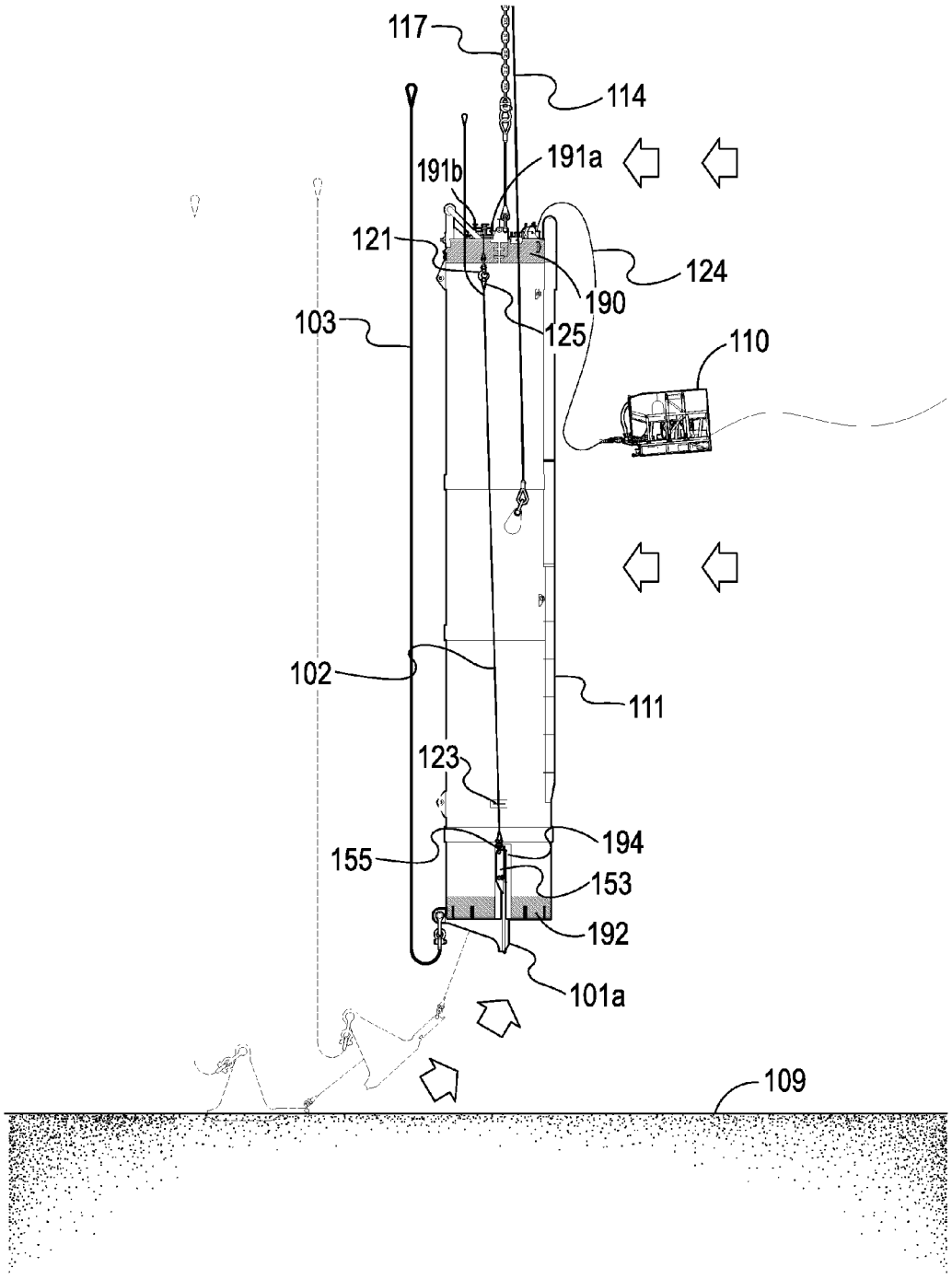
FIG. 23 shows the follower being raised by the AHV and the plate anchor being inserted into supporting slots in the follower by the follower top winches according to one exemplary embodiment of the disclosed systems and methods.

In the illustrated exemplary embodiment of FIG. 23, a docking feature is provided in the form of two anchor docking slots 194 that are defined in opposing sides of hollow distal end 192 of follower 111. In this embodiment, the anchor docking slots 194 are configured with dimensions and size that are complementary to the outer dimensions and size of keying flap 153 and fluke 150 of plate anchor 101 so as to allow the opposing anchor docking slots to cooperate to receive the keying flap 153 in an aligned position as shown. In this regard, orientation of anchor 101 rotates by about 90 degrees as it is retrieved due to the location of recovery pendants 102 at the outboard edge of keying flap 153 and the positioning of the bottom set of winch line guides 123 adjacent and aligned with the docking slots 194 of follower 111. This rotation of anchor 101 places the primary plane of fluke 150 and keying flap 153 in a substantially vertically oriented position that aligns with docking slots 194 to allow keying flap 153 to be received in docking slots 194 such that anchor 101 is at least partially received in the hollow distal end of follower 111 in a docked embedding position, i.e., a position that is suitable for operably embedding plate anchor 111 into seafloor 109 with suction follower 111. As the winch wires 122 pull the anchor 101 into a docking feature of the suction follower 111, the ROV 110 may assist in assuring the rigging isn't fouled and the anchor 101 fully slots into the opposing docking slots 194 of the follower 111 to dock the anchor 101 at or near the distal end (penetrating end) of the follower 111 in a docked position suitable for embedding plate anchor 111 into seafloor 109 in a manner as will be further described herein. The ROV 110 may make a full inspection of the anchor 101 and rigging at this time after stowing the flying lead 124 to the follower top winches.

It will be understood that the illustrated opposing docking slots 194 are just one exemplary embodiment of an anchor docking feature that may be provided on the distal end 192 of a follower 111 for retaining a plate anchor 101 in relation to distal end 192 of follower 111 in a position suitable for facilitating embedment of the plate anchor 101 into a seafloor 109 by the follower 111. An example of another possible type or configuration of anchor docking feature includes, but is not limited to, an anchor support structure (e.g., manufactured of tubular plate or other suitable material/s) that is attached to the distal end 192 of the follower 111 in lieu of the docking slots 193. Such a structure may be so provided in any form suitable for supporting a plate anchor in a docked engagement with the distal end of a suction follower while the distal end of the suction follower is suspended in a position above the seafloor, lowered to the seafloor, and during anchor embedment operations.

Figure 24A:
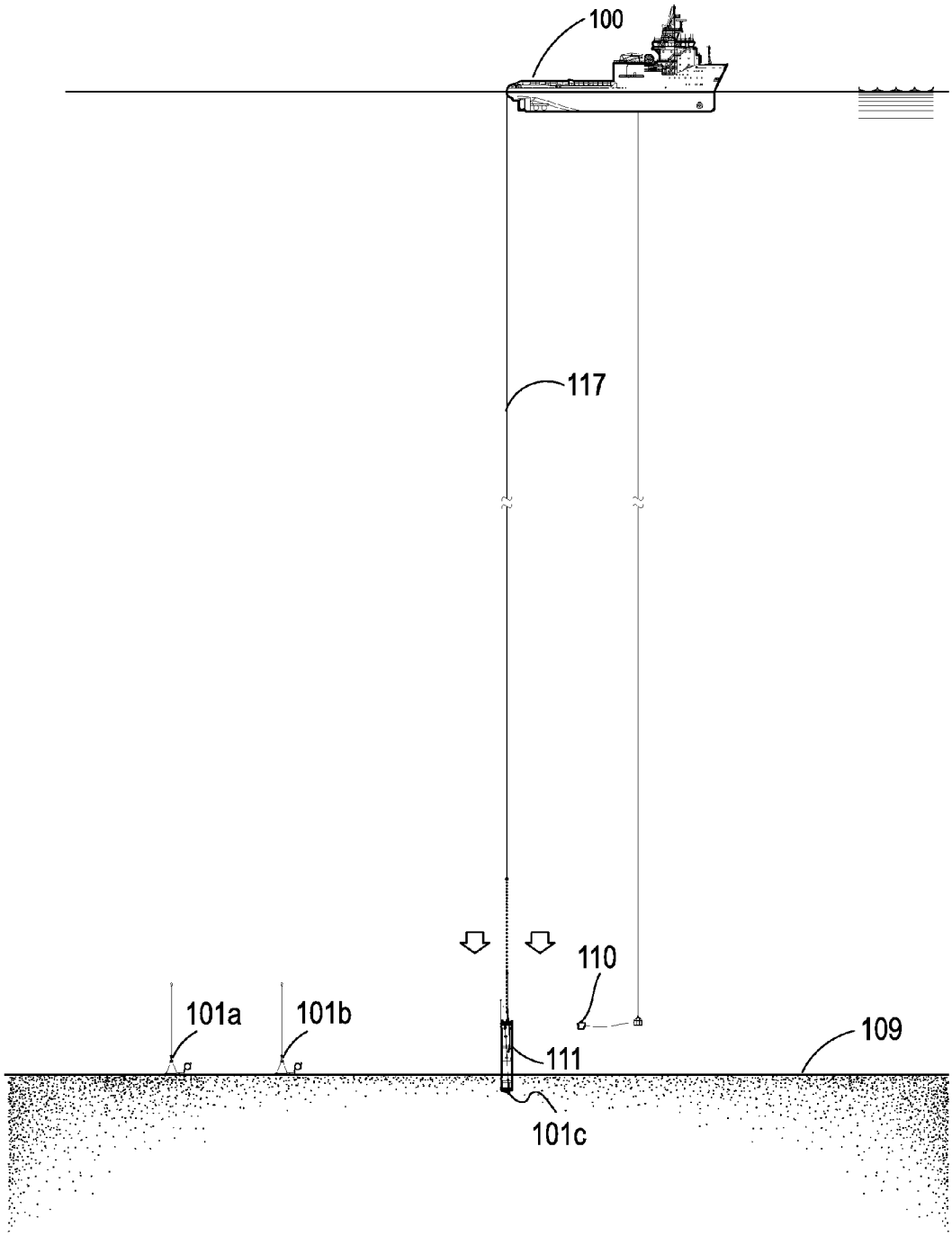
FIGS. 24A and 24B show the suction follower with the batch-set plate anchor now installed moved to its target location and the suction follower being lowered to self-penetration depth according to one exemplary embodiment of the disclosed systems and methods.
Figure 24B:
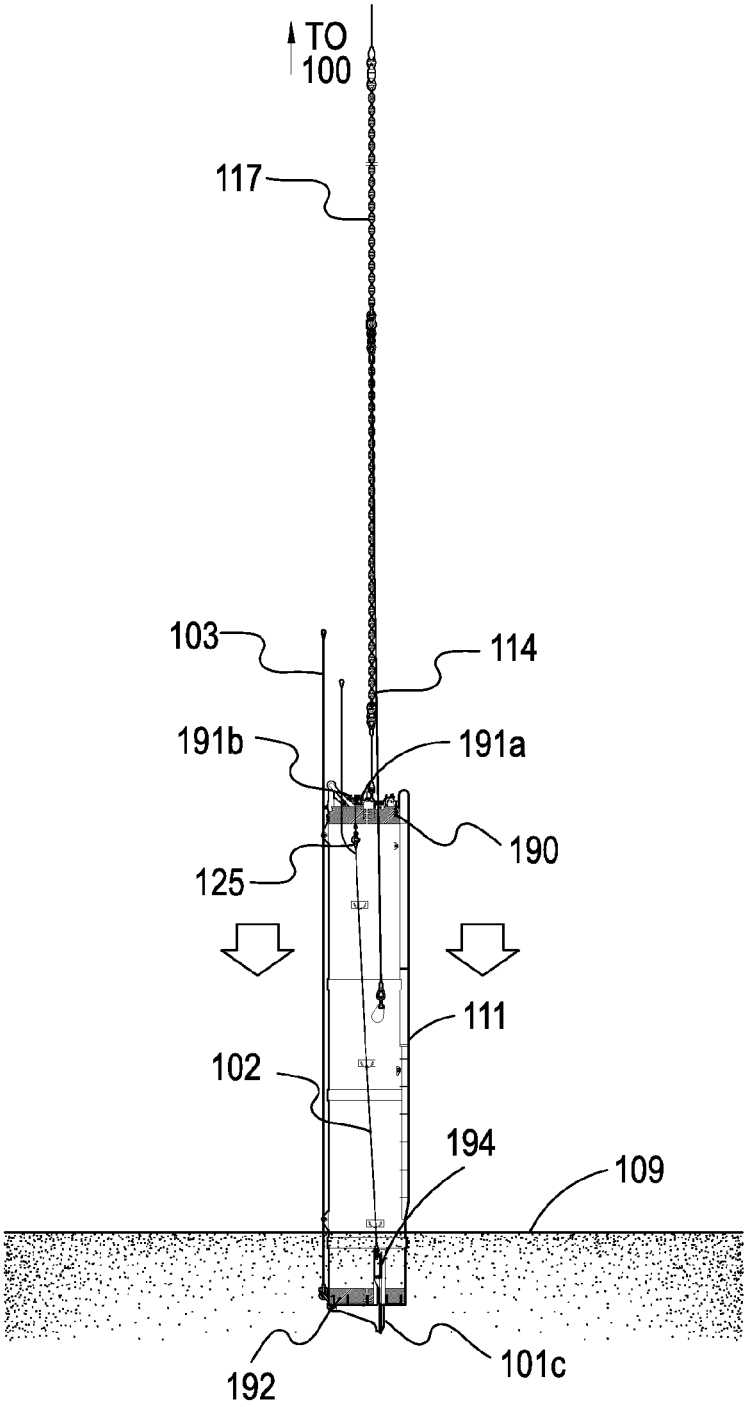

In FIGS. 24A and 24B the AHV 100 is shown moved to the anchor's target location. While AHV 100 maintains position, and after confirmation by the ROV 110 that the follower 111 is in the correct orientation, the follower 111 is lowered distal end first until it reaches self-weight penetration depth in the seafloor 109 with the docked anchor 101 embedded into the seafloor 109 as shown. From this stage onward, conventional methods of suction embedment, anchor release and extraction and raising of the suction follower from the seafloor and anchor keying may be implemented so as to undock the embedded anchor assembly from the suction follower to leave the undocked first anchor assembly embedded in the sea floor. This may be accomplished, for example, by first using internal water overpressure in the suction follower followed by tension on the recovery line. Further information on suction follower and anchor configuration, anchor embedment, anchor release, and suction follower extraction may be found described in U.S. Pat. Nos. 5,992,060 and 6,122,847, each of which is incorporated herein by reference in its entirety. This procedure is sequentially repeated for each of the remaining multiple anchors to be installed followed by recovery of the suction follower 111 onto the AHV 100. It will be understood that all of the multiple anchors 101 may be so sequentially installed in a batch manner by the suction follower 111 without retrieving the follower into the AHV 100 or above the sea surface. Although FIG. 24 illustrates a total of three plate anchors 101, i.e., one embedded plate anchor 101 docked with a suction follower 111 and two nearby plate anchors 101 set out on the seafloor 109 waiting to dock to and be embedded by the suction follower 111, it will be understood that any number of plate anchors (e.g., eight plate anchors 101, twelve plate anchors 101, more than ten plate anchors, etc.) may be set out on the sea floor and then sequentially embedded by a common suspended suction follower 111 before again retrieving the suction follower 111 above the sea surface until all plate anchors 101 have been installed (embedded).

While the invention may be adaptable to various modifications and alternative forms, specific examples and exemplary embodiments have been shown by way of example and described herein. However, it should be understood that the invention is not intended to be limited to the particular forms disclosed. Rather, the invention is to cover all modifications, equivalents, and alternatives falling within the spirit and scope of the systems and methods described herein. Moreover, the different aspects of the disclosed systems and methods may be utilized in various combinations and/or independently. Thus the invention is not limited to only those combinations shown herein, but rather may include other combinations.

What is claimed is:

1. A method for installing one or more plate anchors in a seafloor underlying a body of water, comprising:

first deploying at least one plate anchor on the seafloor, the plate anchor comprising an anchor section that comprises a shank coupled to a substantially planar fluke section, and a keying flap coupled to the fluke section, and where the plate anchor further comprises at least one recovery pendant coupled to the keying flap;

then deploying a suction follower into the body of water into a position suspended above the seafloor, the suction follower comprising an anchor docking feature that includes anchor docking slots defined in opposing sides of a hollow distal end of the follower, each of the anchor docking slots being configured with dimensions and size that are complementary to the outer dimensions and size of the keying flap and fluke section of the plate anchor so as to allow the opposing anchor docking slots to cooperate to at least partially receive the plate anchor in the hollow distal end of the follower in a docked embedding position;

then docking the deployed plate anchor to the suction follower, and lowering the suction follower with the docked plate anchor to embed the docked plate anchor into the seafloor; and then raising the suction follower above the seafloor to undock the embedded plate anchor from the suction follower;

where the method further comprises:

performing the step of first deploying at least one plate anchor on the seafloor such that the substantially planar fluke section and keying flap rest on the seafloor in substantially parallel relationship with the seafloor, then performing the step of deploying a suction follower by deploying the suction follower distal end downward into the body of water into a position suspended above the seafloor, then performing the step of docking the deployed plate anchor to the suction follower by using the recovery pendant of the plate anchor to retrieve and orient the keying flap and fluke section of the plate anchor into substantial alignment with the opposing anchor docking slots such that the keying flap and fluke section are at least partially received in the opposing anchor docking slots to place the plate anchor in docked engagement with the distal end of the suction follower while the distal end of the suction follower is suspended in a position above the seafloor, then performing the step of lowering the suction follower with the docked plate anchor to embed the docked plate anchor into the seafloor, and then performing the step of raising the suction follower above the seafloor to undock the embedded plate anchor from the suction follower.

2. The method of claim 1, where the suction follower further comprises an integral anchor retrieval mechanism that includes at least one integral actuator; and where the method further comprises using the integral actuator to retrieve the recovery pendant of the plate anchor.

3. The method of claim 1, further comprising:

first performing the step of deploying at least one plate anchor on the seafloor by deploying multiple separate plate anchors on the seafloor that include at least first and second separate and different plate anchors, each of the multiple plate anchors comprising an anchor section;

then performing the step of deploying a suction follower into the body of water into a position suspended above the seafloor;

then performing the step of docking the deployed plate anchor to the suction follower by docking a first one of the deployed separate plate anchors separately to the suction follower, and lowering the suction follower with the docked first plate anchor to embed the docked first plate anchor into the seafloor;

then performing the step of raising the suction follower above the seafloor to undock the embedded first plate anchor from the suction follower;

then docking a second and different one of the deployed plate anchors separately to the suction follower, and lowering the suction follower with the docked second plate anchor to embed the docked second plate anchor into the seafloor; and then raising the suction follower above the seafloor to undock the embedded second plate anchor from the suction follower.

4. The method of claim 3, where the suction follower comprises a proximal end and a distal end; where the suction follower further comprises an anchor docking feature provided at the distal end of the suction follower; where the step of docking the first one of the deployed separate plate anchors to the distal end of the suction follower comprises docking the first plate anchor with the anchor docking feature; and where the step of docking the second one of the deployed separate plate anchors to the distal end of the suction follower comprises docking the second plate anchor with the anchor docking feature.

5. The method of claim 1, where the step of deploying at least one plate anchor on the seafloor comprises deploying multiple separate plate anchors on the seafloor by lowering the multiple separate plate anchors together into the water as a linked anchor assembly.

6. The method of claim 5, where the step of deploying multiple separate plate anchors on the seafloor comprises deploying the multiple plate anchors at different locations on the seafloor without again raising the linked anchor assembly to a surface of the water by:

first lowering the multiple separate plate anchors together into the water and toward the seafloor as a linked anchor assembly; and then separately detaching the individual plate anchors one at a time from the linked anchor assembly at different locations above the seafloor to leave each of the separately detached individual plate anchors deployed at a separate and different location on the seafloor.

7. The method of claim 5, where the linked anchor assembly comprises the multiple separate plate anchors which are coupled together in individually detachable relationship, and where the method comprises performing the step of lowering the multiple separate plate anchors together into the water by lowering the linked anchor assembly from an installation or handling vessel into the body of water overlying the seafloor.

8. The method of claim 1, where the step of deploying at least one plate anchor on the seafloor comprises deploying multiple separate plate anchors on the seafloor, and where the method further comprises:

performing the step of deploying the suction follower into the body of water by lowering the suction follower below a surface of the water into the position suspended above the seafloor; and then performing all the following steps without again raising the suction follower above the surface of the water:

performing the step of docking the deployed plate anchor to the suction follower by docking a first one of the deployed separate plate anchors separately to the suction follower, and lowering the suction follower with the docked first plate anchor to embed the docked first plate anchor into the seafloor, then performing the step of raising the suction follower above the seafloor to undock the embedded first plate anchor from the suction follower, then docking a second and different one of the deployed plate anchors separately to the suction follower, and lowering the suction follower with the docked second plate anchor to embed the docked second plate anchor into the seafloor, and then raising the suction follower above the seafloor to undock the embedded second plate anchor from the suction follower.

9. The method of claim 8, where the deployed multiple separate plate anchors on the seafloor include at least the first plate anchor, the second plate anchor and a third separate and different plate anchor, and where the method further comprises:

then docking the third deployed plate anchor separately to the suction follower, and lowering the suction follower with the docked third plate anchor to embed the docked third plate anchor into the seafloor; and then raising the suction follower above the seafloor to undock the embedded third plate anchor from the suction follower.

10. The method of claim 8, where the suction follower comprises a proximal end and a distal end; where each of the multiple plate anchors comprises an anchor section coupled to a recovery pendant; and where the method further comprises:

performing the step of docking the first one of the deployed separate plate anchors separately to the suction follower by docking the first one of the deployed separate plate anchors to the distal end of the suction follower by using the recovery pendant of the first one of the plate anchors to retrieve the first one of the plate anchors into docked engagement with the distal end of the suction follower while the distal end of the suction follower is suspended in a position above the seafloor;

then performing the step of lowering the suction follower with the docked first plate anchor to embed the docked first plate anchor into the seafloor by lowering the distal end of the suction follower with the docked first one of the plate anchors to embed the distal end of the suction follower with the docked first plate anchor into the seafloor;

then performing the step of raising the suction follower above the seafloor to undock the embedded plate anchor from the suction follower by raising the distal end of the suction follower above the seafloor and undocking the embedded first one of the plate anchors from the suction follower;

then performing the step of docking a second and different one of the deployed plate anchors separately to the suction follower by docking the second one of the deployed separate plate anchors to the distal end of the suction follower by using the recovery pendant of the second one of the plate anchors to retrieve the second one of the plate anchors into docked engagement with the distal end of the suction follower while the distal end of the suction follower is suspended in a position above the seafloor;

then performing the step of lowering the suction follower with the docked second plate anchor to embed the docked second plate anchor into the seafloor by lowering the distal end of the suction follower with the docked second one of the plate anchors to embed the distal end of the suction follower with the docked second plate anchor into the seafloor; and then performing the step of raising the suction follower above the seafloor to undock the embedded second plate anchor from the suction follower by raising the distal end of the suction follower above the seafloor and undocking the embedded second one of the plate anchors from the suction follower.

11. The method of claim 1, where the suction follower comprises an elongated follower body with a proximal end and a distal end, and where the method further comprises:

performing the step of docking the deployed plate anchor to the suction follower by using an anchor docking feature provided at the distal end of the suction follower to at least partially receive the deployed plate anchor in a docked embedding position; and using an integral anchor retrieval mechanism of the suction follower to retrieve the deployed plate anchor into the docked embedding position with the docking feature of the suction follower.

12. The method of claim 11, further comprising employing the integral anchor retrieval mechanism to use a recovery pendant of the deployed plate anchor to perform the step of retrieving the deployed plate anchor into the docked embedding position with the docking feature of the suction follower.

13. The method of claim 12, further comprising using a remote operated vehicle (ROV) to power the integral anchor retrieval mechanism to perform the step of using the recovery pendant of the deployed plate anchor to retrieve the deployed plate anchor into the docked embedding position with the docking feature of the suction follower.

14. The method of claim 1, further comprising performing the step of deploying at least one plate anchor on the seafloor by deploying multiple separate plate anchors from a vessel into a body of water overlying a seafloor by lowering the multiple separate plate anchors together into the water as a linked anchor assembly.

15. The method of claim 14, further comprising:

first performing the step of lowering the multiple separate plate anchors together into the water and toward the seafloor as a linked anchor assembly; and then separately detaching the multiple plate anchors one at time from the linked anchor assembly without again raising the linked anchor assembly to a surface of the water.

16. The method of claim 14, further comprising:

first performing the step of lowering the multiple separate plate anchors together into the water and toward the seafloor as a linked anchor assembly;

then separately detaching the multiple plate anchors one at a time from the linked anchor assembly by separately deploying the multiple plate anchors one at a time on the seafloor without raising the linked anchor assembly to a surface of the water by:

individually detaching a first one of the multiple plate anchors from the linked anchor assembly to leave the detached first plate anchor on the seafloor at a first location, then moving the remainder of the linked anchor assembly to a second and different location above the seafloor, and then individually detaching a second one of the multiple plate anchors from the linked anchor assembly to leave the detached second plate anchor on the seafloor at the second location without again raising the linked anchor assembly to a surface of the water.

17. The method of claim 16, further comprising using a remote operated vehicle (ROV) to perform the steps of individually detaching the first one of the multiple plate anchors from the linked anchor assembly to leave the detached first plate anchor on the seafloor at the first location; and individually detaching the second one of the multiple plate anchors from the linked anchor assembly to leave the detached second plate anchor on the seafloor at the second location without again raising the linked anchor assembly to a surface of the water.

18. The method of claim 14, further comprising assembling the multiple individual separate plate anchors together as the linked anchor assembly on a deck of an installation or handling vessel.

19. A method for installing one or more plate anchors in a seafloor underlying a body of water, comprising:

first deploying at least one plate anchor on the seafloor, the plate anchor comprising an anchor section;

then deploying a suction follower into the body of water into a position suspended above the seafloor;

then docking the deployed plate anchor to the suction follower, and lowering the suction follower with the docked plate anchor to embed the docked plate anchor into the seafloor; and then raising the suction follower above the seafloor to undock the embedded plate anchor from the suction follower;

where the step of deploying at least one plate anchor on the seafloor comprises deploying multiple separate plate anchors on the seafloor, and where the method further comprises performing the step of deploying the suction follower into the body of water by lowering the suction follower below a surface of the water into the position suspended above the seafloor, and then performing all the following steps without again raising the suction follower above the surface of the water:

performing the step of docking the deployed plate anchor to the suction follower by docking a first one of the deployed separate plate anchors separately to the suction follower, and lowering the suction follower with the docked first plate anchor to embed the docked first plate anchor into the seafloor, then performing the step of raising the suction follower above the seafloor to undock the embedded first plate anchor from the suction follower, then docking a second and different one of the deployed plate anchors separately to the suction follower, and lowering the suction follower with the docked second plate anchor to embed the docked second plate anchor into the seafloor, and then raising the suction follower above the seafloor to undock the embedded second plate anchor from the suction follower;

where the suction follower comprises a proximal end and a distal end; where each of the multiple plate anchors comprises an anchor section coupled to a recovery pendant; and where the method further comprises:

performing the step of docking the first one of the deployed separate plate anchors separately to the suction follower by docking the first one of the deployed separate plate anchors to the distal end of the suction follower by using the recovery pendant of the first one of the plate anchors to retrieve the first one of the plate anchors into docked engagement with the distal end of the suction follower while the distal end of the suction follower is suspended in a position above the seafloor, then performing the step of lowering the suction follower with the docked first plate anchor to embed the docked first plate anchor into the seafloor by lowering the distal end of the suction follower with the docked first one of the plate anchors to embed the distal end of the suction follower with the docked first plate anchor into the seafloor, then performing the step of raising the suction follower above the seafloor to undock the embedded first anchor from the suction follower by raising the distal end of the suction follower above the seafloor and undocking the embedded first one of the plate anchors from the suction follower, then performing the step of docking a second and different one of the deployed plate anchors separately to the suction follower by docking the second one of the deployed separate plate anchors to the distal end of the suction follower by using the recovery pendant of the second one of the plate anchors to retrieve the second one of the plate anchors into docked engagement with the distal end of the suction follower while the distal end of the suction follower is suspended in a position above the seafloor;

then performing the step of lowering the suction follower with the docked second plate anchor to embed the docked second plate anchor into the seafloor by lowering the distal end of the suction follower with the docked second one of the plate anchors to embed the distal end of the suction follower with the docked second plate anchor into the seafloor, and then performing the step of raising the suction follower above the seafloor to undock the embedded second plate anchor from the suction follower by raising the distal end of the suction follower above the seafloor and undocking the embedded second one of the plate anchors from the suction follower;

where the suction follower comprises one or more integral anchor retrieval mechanisms configured to temporarily couple to the recovery pendant of each of the first and second plate anchors for retrieval thereof; and where the method further comprises:

performing the step of docking the first one of the deployed separate plate anchors to the distal end of the suction follower by first coupling the one or more integral anchor retrieval mechanisms to the recovery pendant of the first one of the plate anchors and using the integral anchor retrieval mechanisms to retrieve the coupled recovery pendant together with the first one of the plate anchors to place the first one of the plate anchors into docked engagement with the distal end of the suction follower while the distal end of the suction follower is suspended in a position above the seafloor, then performing the step of lowering the distal end of the suction follower with the docked first one of the plate anchors to embed the distal end of the suction follower with the docked first plate anchor into the seafloor, then performing the step of raising the distal end of the suction follower above the seafloor and undocking the embedded first one of the plate anchors from the suction follower by uncoupling the one or more integral anchor retrieval mechanisms from the recovery pendant of the first one of the plate anchors and raising the distal end of the suction follower above the seafloor and undocking the embedded first one of the plate anchors from the suction follower, then performing the step of docking the second one of the employed separate plate anchors to the distal end of the suction follower by coupling the one or more integral anchor retrieval mechanisms to the recovery pendant of the second one of the plate anchors and using the integral anchor retrieval mechanisms to retrieve the coupled recovery pendant together with the second one of the plate anchors to place the second one of the plate anchors into docked engagement with the distal end of the suction follower while the distal end of the suction follower is suspended in a position above the seafloor, then performing the step of lowering the distal end of the suction follower with the docked second one of the plate anchors to embed the distal end of the suction follower with the docked second plate anchor into the seafloor, and then performing the step of raising the distal end of the suction follower above the seafloor and undocking the embedded second one of the plate anchors from the suction follower by uncoupling the one or more integral anchor retrieval mechanisms from the recovery pendant of the second one of the plate anchors and raising the distal end of the suction follower above the seafloor and undocking the embedded second one of the plate anchors from the suction follower.

20. The method of claim 19, further comprising using a remote operated vehicle (ROV) to perform the step of coupling the one or more integral anchor retrieval mechanisms to the recovery pendant of the first one of the plate anchors.

21. The method of claim 19, further comprising using a remote operated vehicle (ROV) to power the one or more integral anchor retrieval mechanisms to perform the step of retrieving the coupled recovery pendant together with the first one of the plate anchors to place the first one of the plate anchors into docked engagement with the distal end of the suction follower while the distal end of the suction follower is suspended in a position above the seafloor.

22. The method of claim 19, further comprising:

using a remote operated vehicle (ROV) to perform the step of coupling the one or more integral anchor retrieval mechanisms to the recovery pendant of the first one of the plate anchors and using the ROV to power the one or more integral anchor retrieval mechanisms to retrieve the coupled recovery pendant together with the first one of the plate anchors to place the first one of the of the plate anchors into docked engagement with the distal end of the suction follower while the distal end of the suction follower is suspended in a position above the seafloor;

then lowering the distal end of the suction follower with the docked first one of the plate anchors to embed the distal end of the suction follower with the docked first plate anchor into the seafloor;

then using the ROV to uncouple the one or more integral anchor retrieval mechanisms from the recovery pendant of the first one of the plate anchors, and raising the distal end of the suction follower above the seafloor and undocking the embedded first one of the plate anchors from the suction follower;

then using the ROV to couple the one or more integral anchor retrieval mechanisms to the recovery pendant of the second one of the plate anchors and using the ROV to power the one or more integral anchor retrieval mechanisms to retrieve the coupled recovery pendant together with the second one of the plate anchors to place the second one of the of the plate anchors into docked engagement with the distal end of the suction follower while the distal end of the suction follower is suspended in a position above the seafloor;

then lowering the distal end of the suction follower with the docked second one of the plate anchors to embed the distal end of the suction follower with the docked second plate anchor into the seafloor; and then using the ROV to uncouple the one or more integral anchor retrieval mechanisms from the recovery pendant of the second one of the plate anchors, and raising the distal end of the suction follower above the seafloor and undocking the embedded second one of the plate anchors from the suction follower.

23. A method for installing one or more plate anchors in a seafloor underlying a body of water, comprising:

first deploying at least one plate anchor on the seafloor, the plate anchor comprising an anchor section;

then deploying a suction follower into the body of water into a position suspended above the seafloor;

then docking the deployed plate anchor to the suction follower, and lowering the suction follower with the docked plate anchor to embed the docked plate anchor into the seafloor; and then raising the suction follower above the seafloor to undock the embedded plate anchor from the suction follower;

where the method further comprises:

first performing the step of deploying at least one plate anchor on the seafloor by deploying multiple separate plate anchors on the seafloor that include at least first and second separate and different plate anchors, each of the multiple plate anchors comprising an anchor section, then performing the step of deploying a suction follower into the body of water into a position suspended above the seafloor, then performing the step of docking the deployed plate anchor to the suction follower by docking the first deployed separate plate anchor separately to the suction follower, and lowering the suction follower with the docked first plate anchor to embed the docked first plate anchor into the seafloor, then performing the step of raising the suction follower above the seafloor to undock the embedded first plate anchor from the suction follower, then docking the second and different deployed plate anchor separately to the suction follower, and lowering the suction follower with the docked second plate anchor to embed the docked second plate anchor into the seafloor, and then raising the suction follower above the seafloor to undock the embedded second plate anchor from the suction follower; and where the anchor section of each of the first and second plate anchors comprises a shank coupled to a substantially planar fluke section, and a keying flap coupled to the fluke section; where each of the first and second plate anchors comprises at least one recovery pendant coupled to the keying flap of the corresponding plate anchor; where the suction follower comprises a proximal end and a hollow distal end; where the suction follower further comprises an anchor docking feature provided at the distal end of the suction follower that includes anchor docking slots defined in opposing sides of the hollow distal end of the follower, each of the anchor docking slots being configured with dimensions and size that are complementary to the outer dimensions and size of the keying flap and fluke section of each of the respective first and second plate anchors so as to allow the opposing anchor docking slots to cooperate to at least partially receive each of the respective first and second plate anchors in the hollow distal end of the follower in a docked embedding position; where the step of docking the first one of the deployed separate plate anchors to the distal end of the suction follower comprises docking the suction follower to the deployed first plate anchor by using the recovery pendant of the first plate anchor to retrieve and orient the keying flap of the first plate anchor into substantial alignment with the opposing anchor docking slots such that the keying flap and fluke section are at least partially received in the opposing anchor docking slots to place the first plate anchor in docked engagement with the distal end of the suction follower while the distal end of the suction follower is suspended in a position above the seafloor; and where the step of docking the second one of the deployed separate plate anchors to the distal end of the suction follower comprises docking the deployed second plate anchor to the suction follower by using the recovery pendant of the second plate anchor to retrieve and orient the keying flap and fluke section of the second plate anchor into substantial alignment with the opposing anchor docking slots such that the keying flap and fluke section are at least partially received in the opposing anchor docking slots to place the second plate anchor in docked engagement with the distal end of the suction follower while the distal end of the suction follower is suspended in a position above the seafloor.

24. A method for installing one or more plate anchors in a seafloor underlying a body of water, comprising:

first deploying at least one plate anchor on the seafloor, the plate anchor comprising an anchor section that comprises a shank coupled to a substantially planar fluke section, and a keying flap coupled to the fluke section, and where the plate anchor further comprises at least one recovery pendant coupled to the keying flap;

then deploying a suction follower into the body of water into a position suspended above the seafloor, the suction follower comprising an anchor docking feature that includes anchor docking slots defined in opposing sides of a hollow distal end of the follower, each of the anchor docking slots being configured with dimensions and size that are complementary to the outer dimensions and size of the keying flap and fluke section of the plate anchor so as to allow the opposing anchor docking slots to cooperate to at least partially receive the plate anchor in the hollow distal end of the follower in a docked embedding position;

then docking the deployed plate anchor to the suction follower, and lowering the suction follower with the docked plate anchor to embed the docked plate anchor into the seafloor; and then raising the suction follower above the seafloor to undock the embedded plate anchor from the suction follower;

where the suction follower comprises an elongated follower body with a proximal end and the distal end, and where the method further comprises:

performing the step of docking the deployed plate anchor to the suction follower by using the anchor docking feature provided at the distal end of the suction follower to at least partially receive the plate anchor in a docked embedding position, and using an integral anchor retrieval mechanism of the suction follower to retrieve the plate anchor into the docked embedding position with the anchor docking feature of the suction follower;

where the method further comprises employing the integral anchor retrieval mechanism to use the recovery pendant of the plate anchor to perform the step of retrieving the plate anchor into the docked embedding position with the anchor docking feature of the suction follower; and where the integral anchor retrieval mechanism comprises a winch coupled to the proximal end of the suction follower, a winch wire coupled to the winch and at least one winch line guide coupled to the side of the suction follower adjacent the anchor docking feature; where the method further comprises using the winch line guide to receive and guide the winch line during retrieval of the plate anchor so as to orient the plate anchor into the docked embedding position with the anchor docking feature of the suction follower.

25. A method for installing one or more plate anchors in a seafloor underlying a body of water, comprising:

first deploying at least one plate anchor on the seafloor, the plate anchor comprising an anchor section that comprises a shank coupled to a substantially planar fluke section, and a keying flap coupled to the fluke section, and where the plate anchor further comprises at least one recovery pendant coupled to the keying flap;

then deploying a suction follower into the body of water into a position suspended above the seafloor, the suction follower comprising an anchor docking feature that includes anchor docking slots defined in opposing sides of a hollow distal end of the follower, each of the anchor docking slots being configured with dimensions and size that are complementary to the outer dimensions and size of the keying flap and fluke section of the plate anchor so as to allow the opposing anchor docking slots to cooperate to at least partially receive the plate anchor in the hollow distal end of the follower in a docked embedding position;

then docking the deployed plate anchor to the suction follower, and lowering the suction follower with the docked plate anchor to embed the docked plate anchor into the seafloor; and then raising the suction follower above the seafloor to undock the embedded plate anchor from the suction follower;

where the suction follower comprises an elongated follower body with a proximal end and the distal end, and where the method further comprises:

performing the step of docking the deployed plate anchor to the suction follower by using the anchor docking feature provided at the distal end of the suction follower to at least partially receive the plate anchor in a docked embedding position, and using an integral anchor retrieval mechanism of the suction follower to retrieve the plate anchor into the docked embedding position with the anchor docking feature of the suction follower;

where the method further comprises employing the integral anchor retrieval mechanism to use the recovery pendant of the plate anchor to perform the step of retrieving the plate anchor into the docked embedding position with the anchor docking feature of the suction follower; and where the integral anchor retrieval mechanism comprises at least one winch coupled to the proximal end of the suction follower; at least two winch wires coupled to the at least one winch, the at least two winch wires configured to be deployed simultaneously on different outside sides of the suction follower with the suction follower being positioned therebetween; at least two separate winch guides coupled adjacent the anchor docking feature on the respective different outside sides of the suction follower; and where the method further comprises using each of the winch line guides to receive and guide a respective one of the two winch lines during retrieval of the plate anchor by simultaneous retrieval of the winch wires on the respective different outside sides of the suction follower using the at least one winch so as to orient the plate anchor into the docked embedding position with the anchor docking feature of the suction follower and with the winch wires positioned on the respective different outside sides of the suction follower.

26. A method for installing one or more plate anchors in a seafloor underlying a body of water, comprising:

first deploying at least one plate anchor on the seafloor, the plate anchor comprising an anchor section that comprises a shank coupled to a substantially planar fluke section, and a keying flap coupled to the fluke section, and where the plate anchor further comprises at least one recovery pendant coupled to the keying flap;

then deploying a suction follower into the body of water into a position suspended above the seafloor, the suction follower comprising an anchor docking feature that includes anchor docking slots defined in opposing sides of a hollow distal end of the follower, each of the anchor docking slots being configured with dimensions and size that are complementary to the outer dimensions and size of the keying flap and fluke section of the plate anchor so as to allow the opposing anchor docking slots to cooperate to at least partially receive the plate anchor in the hollow distal end of the follower in a docked embedding position;

then docking the deployed plate anchor to the suction follower, and lowering the suction follower with the docked plate anchor to embed the docked plate anchor into the seafloor; and then raising the suction follower above the seafloor to undock the embedded plate anchor from the suction follower;

where the method further comprises performing the step of deploying at least one plate anchor on the seafloor by deploying multiple separate plate anchors from a vessel into a body of water overlying a seafloor by lowering the multiple separate plate anchors together into the water as a linked anchor assembly;

where the method further comprises assembling the multiple individual separate plate anchors together as the linked anchor assembly on a deck of an installation or handling vessel; and where the step of assembling the multiple individual separate plate anchors together as a linked anchor assembly comprises coupling at least one anchor connection link between each pair of adjacent plate anchors to couple them together within the linked anchor assembly.

27. The method of claim 26, where the at least one anchor connection link comprises the at least one recovery pendant.

28. The method of claim 27, where each of the plate anchors comprises an anchor section having a shank coupled to a substantially planar fluke section, and a keying flap coupled to the fluke section; where the step of assembling comprises coupling the at least one recovery pendant between the keying flap of a first one of the multiple separate plate anchors and the fluke of a second one of the multiple separate plate anchors to form a linked anchor assembly that includes the first and second plate anchors; and where the step of lowering the linked anchor assembly comprises:

lowering the first plate anchor into the water before the second plate anchor with the recovery pendant supporting the first plate anchor in a suspended position beneath the second plate anchor;

supporting the second plate anchor by its keying flap in a suspended position above the first plate anchor; and lowering the second plate anchor by its keying flap into the water in its suspended position above the first plate anchor to lower both the first and second plate anchors of the linked anchor assembly into the water.

29. A method for installing one or more plate anchors in a seafloor underlying a body of water, comprising:

first deploying at least one plate anchor on the seafloor, the plate anchor comprising an anchor section that comprises a shank coupled to a substantially planar fluke section, and a keying flap coupled to the fluke section, and where the plate anchor further comprises at least one recovery pendant coupled to the keying flap;

then deploying a suction follower into the body of water into a position suspended above the seafloor, the suction follower comprising an anchor docking feature that includes anchor docking slots defined in opposing sides of a hollow distal end of the follower, each of the anchor docking slots being configured with dimensions and size that are complementary to the outer dimensions and size of the keying flap and fluke section of the plate anchor so as to allow the opposing anchor docking slots to cooperate to at least partially receive the plate anchor in the hollow distal end of the follower in a docked embedding position;

then docking the deployed plate anchor to the suction follower, and lowering the suction follower with the docked plate anchor to embed the docked plate anchor into the seafloor; and then raising the suction follower above the seafloor to undock the embedded plate anchor from the suction follower;

where the step of deploying at least one plate anchor on the seafloor comprises deploying multiple separate plate anchors on the seafloor by lowering the multiple separate plate anchors together into the water as a linked anchor assembly;

where the linked anchor assembly comprises the multiple separate plate anchors which are coupled together in individually detachable relationship, and where the method comprises performing the step of lowering the multiple separate plate anchors together into the water by lowering the linked anchor assembly from an installation or handling vessel into the body of water overlying the seafloor; and where the method further comprises coupling the multiple separate plate anchors together in the linked anchor assembly by at least one anchor connection link attached to and extending between each pair of adjacent plate anchors of the linked anchor assembly.

30. The method of claim 29, where the at least one anchor connection link comprises the recovery pendant.

31. The method of claim 29, where each of the plate anchors comprises an anchor section having a shank coupled to a substantially planar fluke section, and a keying flap coupled to the fluke section; where the anchor connection link comprises the at least one recovery pendant; and where the method further comprises performing the step of coupling the multiple separate plate anchors together by coupling the at least one recovery pendant between the keying flap of a first one of the multiple separate plate anchors and the fluke section of a second one of the multiple separate plate anchors.

32. The method of claim 29, further comprising decoupling at least one end of each anchor connection link from at least one of the plate anchors of the linked anchor assembly to detach one of the multiple plate anchors from the linked anchor assembly.

33. The method of claim 29, further comprising decoupling at least one end of each anchor connection link underwater from at least one of the plate anchors of the linked anchor assembly by using a remote operated vehicle (ROV) to detach the at least one of the multiple plate anchors from the linked anchor assembly.

* * * * *